US008177324B1

(12) United States Patent
Jones et al.

(10) Patent No.: US 8,177,324 B1
(45) Date of Patent: May 15, 2012

(54) PRINTERS AND APPARATUS TO CLEAN PRINTER SURFACES

(76) Inventors: Gene D. Jones, Yacolt, WA (US); Kenneth Williams, Vancouver, WA (US); Jeffrey R. Blackman, Vancouver, WA (US)

( * ) Notice: Subject to any disclaimer, the term of this patent is extended or adjusted under 35 U.S.C. 154(b) by 0 days.

(21) Appl. No.: 12/915,727

(22) Filed: Oct. 29, 2010

(51) Int. Cl.
*B41J 2/165* (2006.01)

(52) U.S. Cl. ..... 347/22; 347/23; 347/32

(58) Field of Classification Search ..... 347/22–33, 347/104; 134/6, 40, 42
See application file for complete search history.

(56) References Cited

U.S. PATENT DOCUMENTS

| | | | | |
|---|---|---|---|---|
| 3,523,319 | A | 8/1970 | Stoever | |
| 3,598,488 | A | 8/1971 | Di Francesco et al. | |
| 6,672,705 | B2 * | 1/2004 | Kitahara et al. | 347/42 |
| 2010/0177141 | A1 | 7/2010 | Hendricks et al. | |

FOREIGN PATENT DOCUMENTS

JP 2002254608 9/2002

* cited by examiner

*Primary Examiner* — Juanita D Jackson

(57) ABSTRACT

Printers and apparatus to clean printer surfaces are disclosed. An example apparatus to clean a surface in a printer includes an endless cleaning material loop and an advancer to advance the cleaning material loop when the loop is not engaged with the surface and to not advance the loop when the loop is engaged with the surface.

20 Claims, 25 Drawing Sheets

PRINTERS AND APPARATUS TO CLEAN PRINTER SURFACES

BACKGROUND

Some printers that use fluid inks use cleaning procedures to maintain the quality of the images formed by these printers. The cleaning procedures may include wiping the print nozzles with a wiper or spitting ink to clear clogged nozzles.

DETAILED DESCRIPTION

Keeping print heads and/or other structures in a printer clean is useful in maintaining print quality of a printer. One way to clean such printer structures is to automatically wipe them with a cleaning wiper. Testing has shown that fabrics are superior to elastomeric wipers in keeping print heads clean. For example, elastomeric wipers may splatter ink on other parts of the printer, which can require additional procedures to maintain the cleanliness of the printer. However, fabric wipers are expensive to implement in wide-media printers. Known fabric wipers are implemented in a reel-to-reel system, in which a takeup reel receives fabric from a supply reel that has been used to wipe the print heads. When the supply reel is emptied, the fabric is discarded. Such discardation is expensive to implement. Further, because the fabric is wound on the takeup reel, the fabric cannot be effectively reused.

Additionally, advancing the material may require costly mechanisms, such as a separate electronic or mechanical drive system or actuator to spin the takeup reel and/or the supply reel, further increasing the cost of implementation for the fabric material.

Example printers and/or apparatus described herein include an endless loop of cleaning material and an advancer to clean a surface in a printer. In some examples, the cleaning material is advanced by the advancer between cleaning procedures to use different portions of the cleaning material for subsequent cleaning procedures. Contaminants deposited on a portion of the cleaning material during a cleaning procedure may then sufficiently adhere to and/or dry upon the cleaning material before the same portion is used to perform another cleaning procedure. For example, in the case of cleaning a print head that uses fluid inks, inks deposited onto the cleaning material are provided sufficient time to dry before the same portion of the cleaning material is re-used to clean the surface, thereby avoiding smearing. Thus, example printers and/or apparatus disclosed herein enable the use of woven fabric wipers in a reusable and economic fashion. Further, example apparatus and/or methods disclosed herein avoid the costly mechanisms such as separate electronic and/or mechanical drive systems employed in known reel-to-reel techniques, thereby achieving further cost savings.

Figure 1:
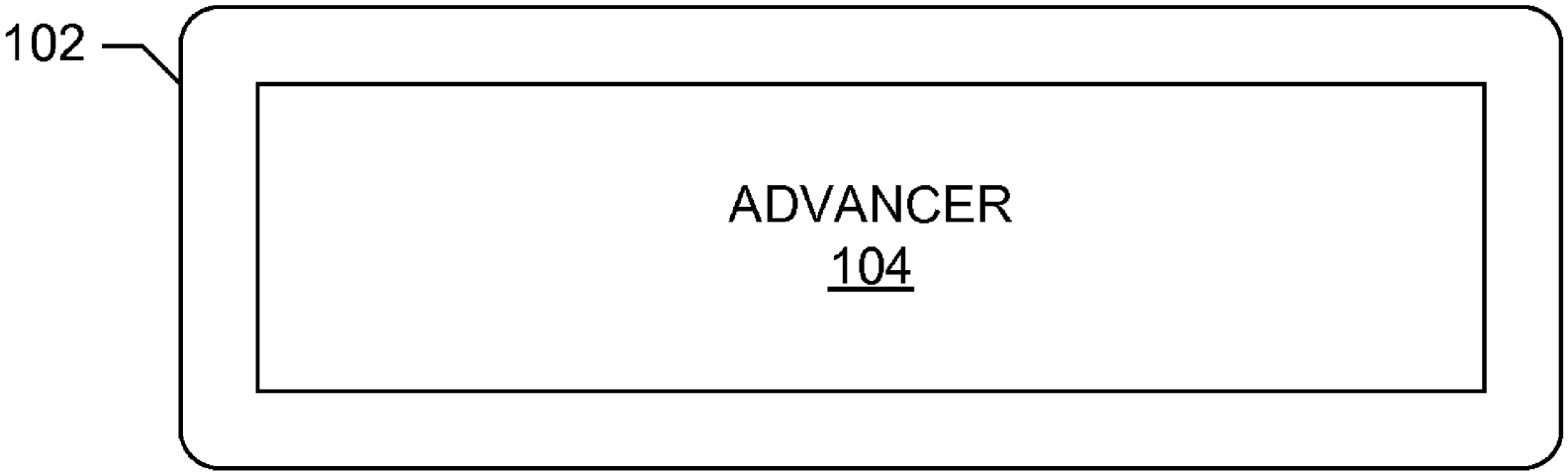
FIG. 1 is a block diagram of an example cleaning material and an advancer.

FIG. 1 is a block diagram of an example cleaning material 102 and an example advancer 104. The example cleaning material 102 of FIG. 1 is configured as an endless loop, such that the cleaning material 102 may be rotated or cycled to reuse the cleaning material 102 multiple times. The example advancer 104 of FIG. 1 advances the cleaning material 102 between cleanings. In some examples, the advancer 104 advances the loop of cleaning material 102 a net distance or rotation to present a ready to use section of the material adjacent to the surface to be cleaned. This can be accomplished by, for example, rotating the material less than a full revolution of the loop or rotating the material one or more full rotations plus a fraction of a rotation of a loop (e.g., incrementally rotating the cleaning material 102). The advancer 104 advances the loop of cleaning material 102 when the cleaning material 102 is not cleaning (e.g., is not engaged or in contact with a surface to be cleaned). Further, the advancer 104 does not advance the loop of cleaning material 102 when the cleaning material 102 is engaged or is in contact with a surface to be cleaned. In some examples, the advancer 104 substantially prevents the cleaning material 102 from advancing during cleaning to improve cleaning performance (e.g., avoid smearing).

Figure 2:
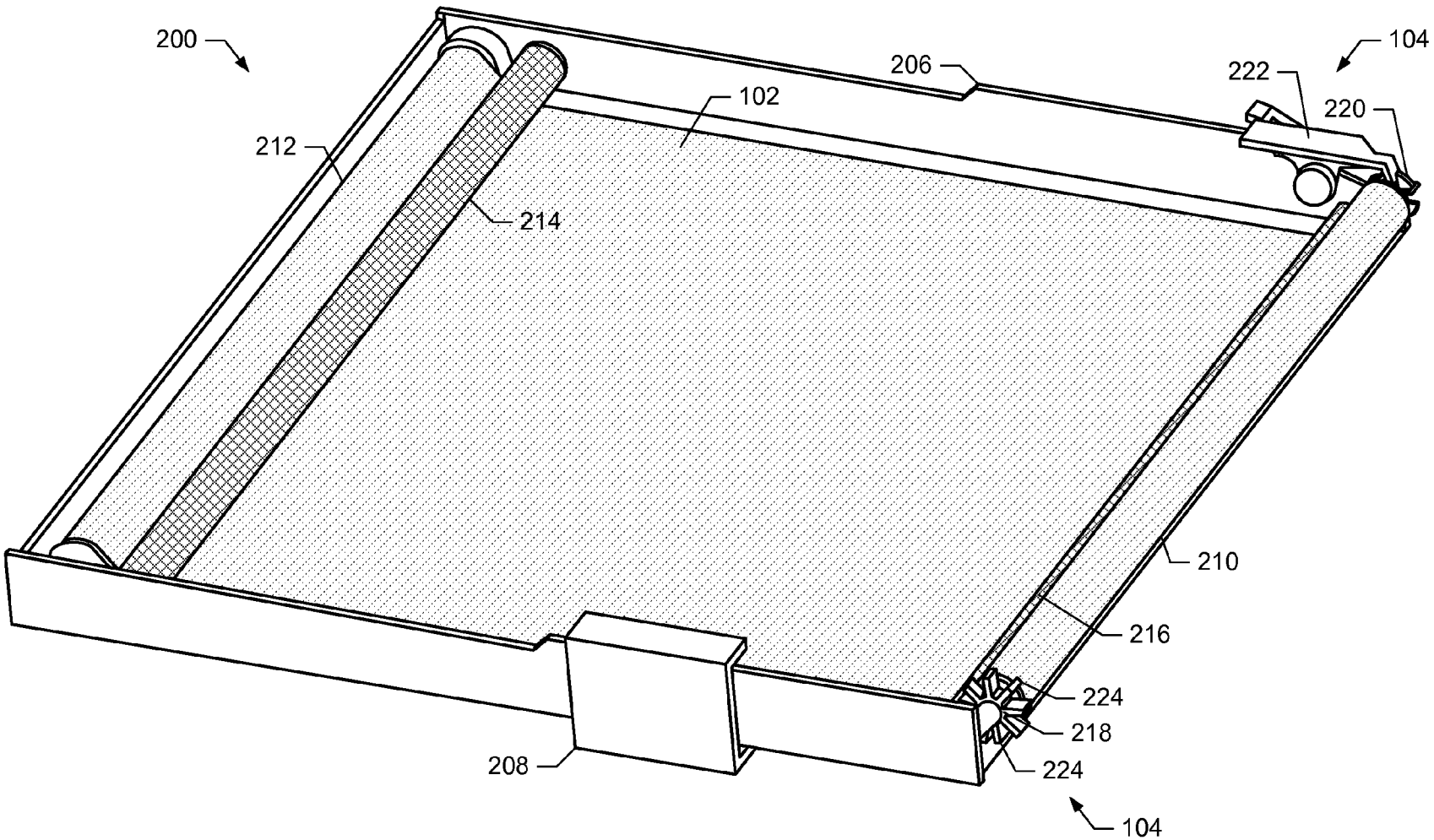
FIG. 2 is an example printer cleaning assembly including an endless loop of cleaning material and an advancer.

FIG. 2 is an example printer cleaning assembly 200 including an example implementation of the endless loop of cleaning material 102 illustrated in FIG. 1 and an example implementation of the advancer 104 of FIG. 1. The example printer cleaning assembly 200 of FIG. 2 includes a housing 206 that may be extended and/or retracted relative to one or more brackets 208. The brackets 208 may be mounted, for example, within a printer. The example printer cleaning assembly 200 reciprocates between a retracted position and an extended position to clean a surface of the printer.

Figure 3:
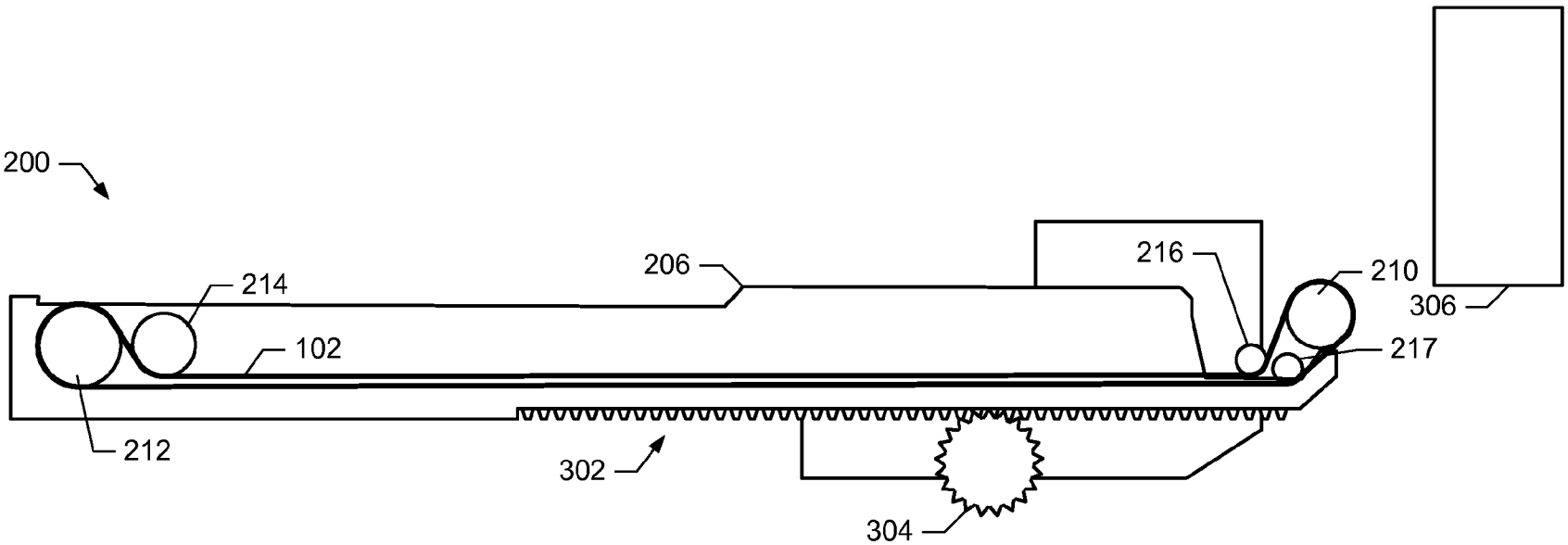
FIG. 3 is a side schematic view of the example printer cleaning sled of FIG. 2.

The example endless loop of cleaning material 102 illustrated in FIG. 2 is supported by a cleaning roller 210 and one or more idle rollers 212, 214, and 216. An additional idle roller 217 not visible in FIG. 2 is illustrated in FIG. 3. In combination, the rollers 210-217 define a travel path along which the cleaning material 102 is advanced. The cleaning roller 210 of the illustrated example may be selectively brought into contact with a printer surface to be cleaned (e.g., a print head) and used to scrub contaminants from the surface using the cleaning material 102. When the cleaning roller 210 and cleaning material 102 are used to clean a surface, at least some of the contaminants are deposited onto the portion of the cleaning material 102 in contact with the surface. If the same portion of the cleaning material 102 is used to clean the same or a different surface a second time before these contaminants can sufficiently adhere to the cleaning material 102 (e.g., before a fluid contaminant dries on the cleaning material 102), the subsequent cleaning will be less effective and may be harmful to the surface (e.g., may result in smearing).

In some examples, the endless loop of cleaning material 102 is constructed using a non-woven fabric material such as Evolon®, available from Freudenberg Nonwovens, or a similar material. Additionally or alternatively, the cleaning material 102 may be implemented using a woven fabric material. The cleaning roller 210 may be constructed using a conformal and/or resilient material that deforms when pressure is applied and returns substantially to its previous (e.g., original) shape when the pressure is removed. The use of a conformal material is desirable to allow the cleaning roller 210 to substantially evenly apply the cleaning material 102 to uneven surfaces to remove contaminants (e.g., to avoid missing pockets and/or to avoid missing area(s) adjacent bump(s), angles, curves, and/or projections on the surface to be cleaned). In some examples, the cleaning roller 210 is mounted on springs (not shown) to urge the cleaning roller 210 and the cleaning material 102 to contact the surface. The pressure provided by the springs may provide additional conformance between the cleaning roller 210 and the surface to be cleaned.

The example advancer of FIG. 2 includes a gear 218, a ratchet wheel 220, and a pawl 222. The gear 218 is located on a first end of the cleaning roller 210 (e.g., in the foreground of FIG. 2). When the gear 218 is rotated, the cleaning roller 210 turns, thereby advancing the cleaning material 102 to position another portion of the cleaning material 102 for cleaning. In some examples, the cleaning roller 210 and the gear 218 are sized such that turning the gear 218 rotates the cleaning roller 210 to incrementally advance the cleaning material 102 some fraction (which may be less than or greater than one) of a full rotation (e.g., advance the cleaning material 102 enough to position a substantially fresh portion of the cleaning material for a subsequent cleaning operation). As used herein, a "fresh" portion of the cleaning material refers to either a portion of the cleaning material that has not previously been used or a portion of the cleaning material that has been previously used but in which the prior use occurred sufficiently in the past to enable contaminants deposited on the portion to have adhered to the previously used portion. The diameter of the cleaning roller 210 is selected to achieve a desired advancement distance of the cleaning material. For example, if the cleaning roller 210 has a larger diameter, the cleaning roller 210 may be rotated less (in terms of angular rotation) to obtain a fresh portion of cleaning material than if the cleaning roller 210 has a smaller diameter. The example gear 218 illustrated in FIG. 2 has a number of teeth 224 which are selected along with, for example, the diameter of the cleaning roller 210 to ensure advancement in desired increments can be achieved.

The example ratchet wheel 220 of FIG. 2 is located on a second end of the cleaning roller 210 opposite the gear 218. The example ratchet wheel 220 of FIG. 2 is fixed to the cleaning roller 210 and, thus, turns with the cleaning roller 210. The example ratchet wheel 220 of FIG. 2 cooperates with the pawl 222 to selectively prevent and/or permit rotation of the cleaning roller 210 (e.g., advancement and/or retraction of the cleaning material 210). The example pawl 222 of FIG. 2 is coupled to the housing 206 adjacent the ratchet wheel 220. When the pawl 222 engages the ratchet wheel 220 as shown in FIG. 2, the pawl 222 substantially prevents the ratchet wheel 220 from moving (e.g., rotating), thereby substantially preventing the gear 218 and the cleaning roller 210 from being rotated. Conversely, when the pawl 222 is disengaged from the ratchet wheel 220, the gear 218 and, thus, the cleaning roller 210 may be rotated. Thus, the advancer 104 may selectively advance (and/or retract) the cleaning material 102 and/or stop the cleaning material 102 from being advanced (and/or retracted). Advancement of the cleaning material 102 may occur in either direction. As used herein, retraction of the cleaning material refers to the direction opposite that of advancement of the cleaning material.

The idle rollers 212-217 are rotatably coupled to the housing 206 (e.g., journalled between opposite sides of the housing 206). In contrast to drive or active rollers (e.g., rollers that are mechanically or electronically driven), the idle rollers 212-217 are journalled to substantially freely turn. The idle rollers 212-217 of the illustrated example do not require differential turning mechanisms to maintain synchronization with the cleaning roller 210.

FIG. 3 is a side schematic view of the example printer cleaning assembly 200 of FIG. 2. The example cleaning assembly 200 of FIG. 3 may be advanced and/or retracted using a track 302 and a gear 304. The example gear 304 of FIG. 3 extends the cleaning roller 210 (e.g., via the housing 206) to contact a surface 306 to be cleaned (e.g., a print head). The gear 304 may be rotatably mounted to, for example, the bracket 208 of FIG. 2 to thereby support the cleaning assembly 200 as it is advanced and/or retracted.

FIGS. 4A-4D illustrate example configurations 400, 402, 404, 406 for the contact and/or idle rollers 210-217 to circulate and/or dry a cleaning material loop 102. The configurations 400-406 illustrated in FIGS. 4A-4D provide different example travel paths for the endless loop of cleaning material 102. In general, a longer loop (e.g., a loop having more cleaning material) has a longer useful life for cleaning surfaces in a printer. However, a longer endless loop also has a longer path and may be more costly to implement. While some configurations 400-406 to provide paths for different lengths of cleaning material are illustrated in FIGS. 4A-4D, any other desired configuration may alternatively be used.

Figure 4A:
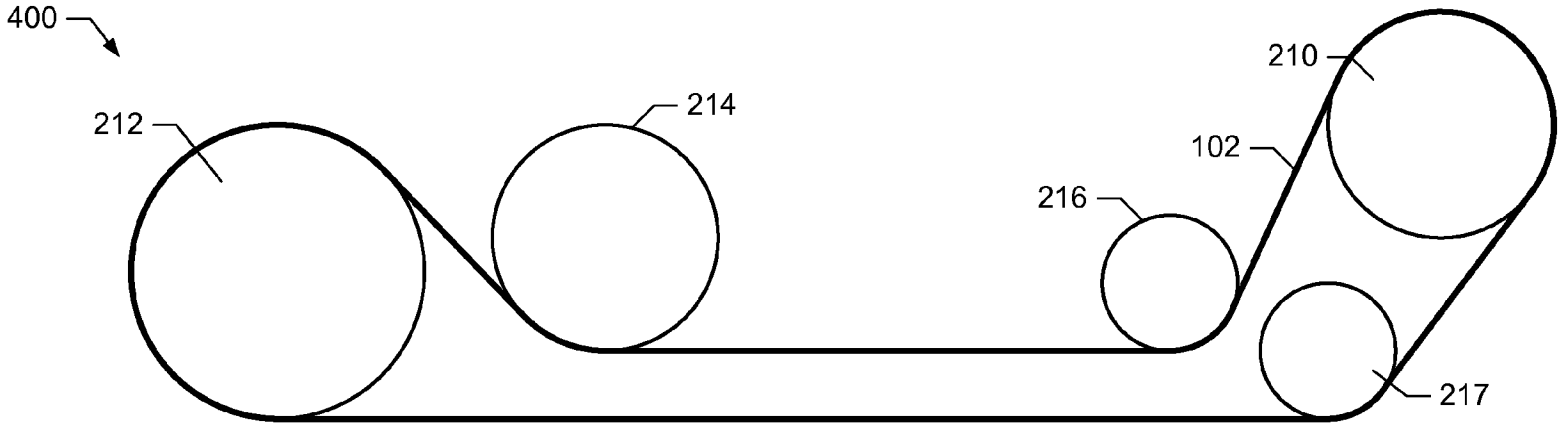
FIGS. 4A-4D illustrate example configurations to circulate and dry cleaning material loops.

The example configuration 400 of FIG. 4A includes a cleaning roller 210 and several idle rollers 212-217. In the illustrated configuration 400 of FIG. 4A, the cleaning roller 210 is also the drive roller, which is rotated by an advancer (e.g., the advancer 104 of FIG. 1) to advance the cleaning material 102 of FIG. 1 along a path defined by the contact and idle rollers 210-217. Alternatively, any of the idle rollers 212-217 may additionally or alternatively be employed as a drive roller. The cleaning roller 210 may be advantageously used as the drive roller because the conformal surface on the cleaning roller 210 may prevent or reduce slipping between the cleaning roller 210 and the cleaning material 102. Using the cleaning roller 210 as the drive roller improves cleaning quality by ensuring the cleaning material 102 is advanced the desired distance and reduces a cost of constructing the rollers 210-217 by using a conformal material only to implement one of the rollers (e.g., the cleaning roller 210). The remaining rollers (e.g., the idle rollers 212-217) may be constructed less expensively by not using the conformal material.

Figure 4B:
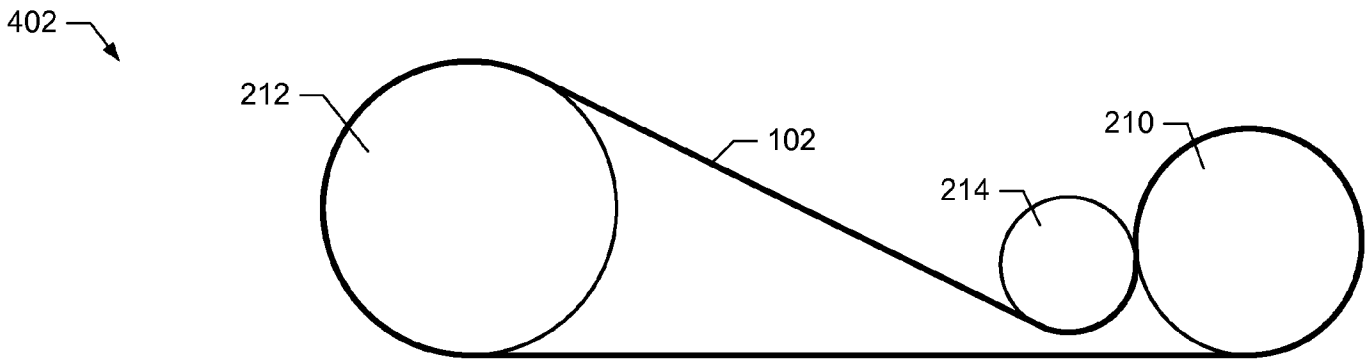
Figure 4C:
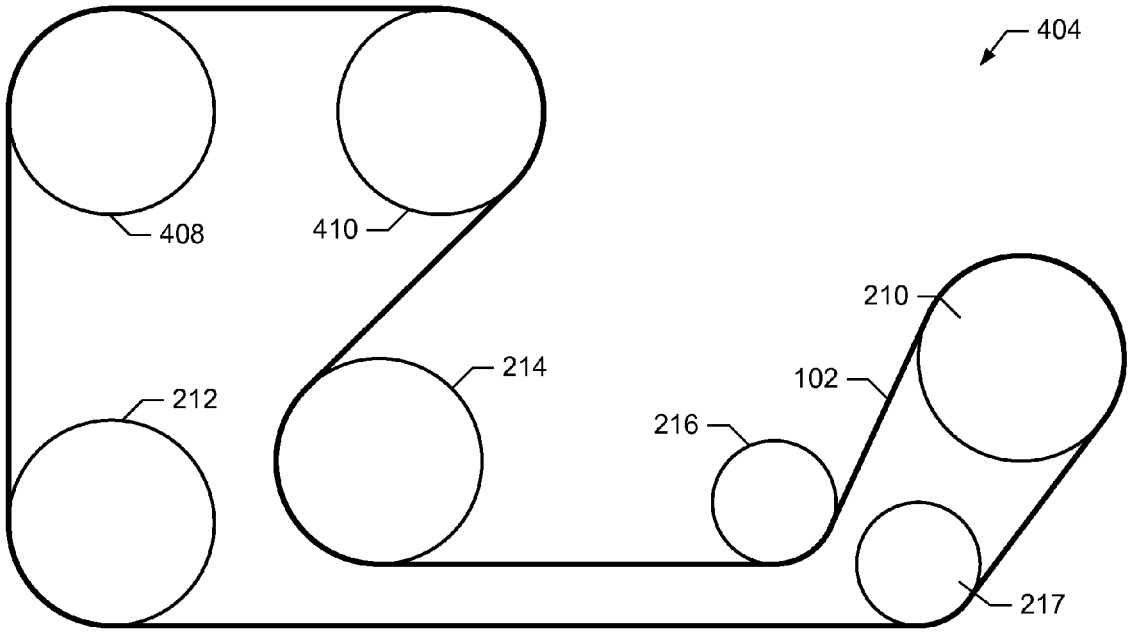

The example configurations 402 and 404 of FIGS. 4B and 4C also include respective cleaning rollers 210 and idle rollers 212-217, 408, 410. The illustrated configuration 402 of FIG. 4B has a shorter length of cleaning material 102 than the configuration 400 of FIG. 4A. The configuration 404 of FIG. 4C has a longer length of cleaning material 102 than either of the configurations 400 or 402. However, the distances between the contact and idle rollers 210-217, 408, and 410 and/or the sizes of the contact and idle rollers 210-217, 408, and 410 may be modified to provide a desired length of the cleaning material 102.

Figure 4D:
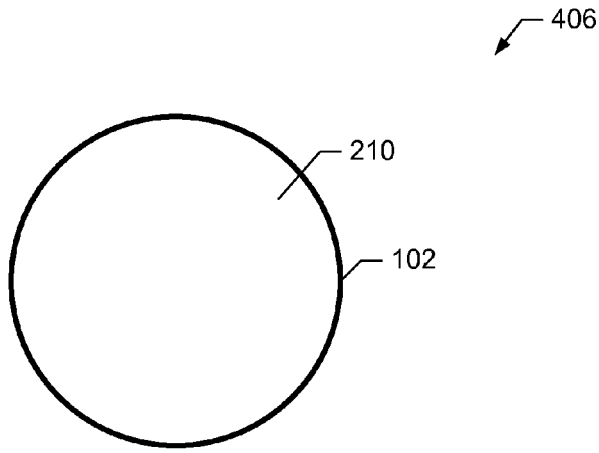

The example configuration 406 of FIG. 4D includes the cleaning roller 210 and the cleaning material 102. Unlike the configurations 400-404, however, the configuration 406 of FIG. 4D does not include the idle rollers 212-217, 408, 410. Instead, in the example configuration 406, the endless loop of cleaning material 102 is wrapped around the circumference of the cleaning roller 210. The size of the cleaning roller 210 used in the illustrated configuration 406 may be based on, for example, how often the surface is to be cleaned, how much of the cleaning material 102 is used per cleaning procedure, and/or how much time the cleaning material 102 takes to dry between cleanings.

FIGS. 5A-5D, 6A-6D, 7A-7D, and 8A-8C are more detailed illustrations of the example advancer 104 of FIGS. 1 and 2 shown in different states of operation. FIGS. 5A-5D illustrate of the example advancer 104 in a rearward position about to and/or currently advancing toward an extended position. FIGS. 6A-6D illustrate the advancer 104 in an example ratchet release position between the rearward and extended positions. FIGS. 7A-7D illustrate the advancer 104 in an example extended position after the cleaning material has been advanced. FIGS. 8A-8C illustrate the example advancer 104 in an example retracting position after a cleaning operation. The example positions shown in FIGS. 5A-8C collectively illustrate a reciprocation between the retracted position and the extended position of the example assembly 200 of FIGS. 2 and 3.

Figure 5A:
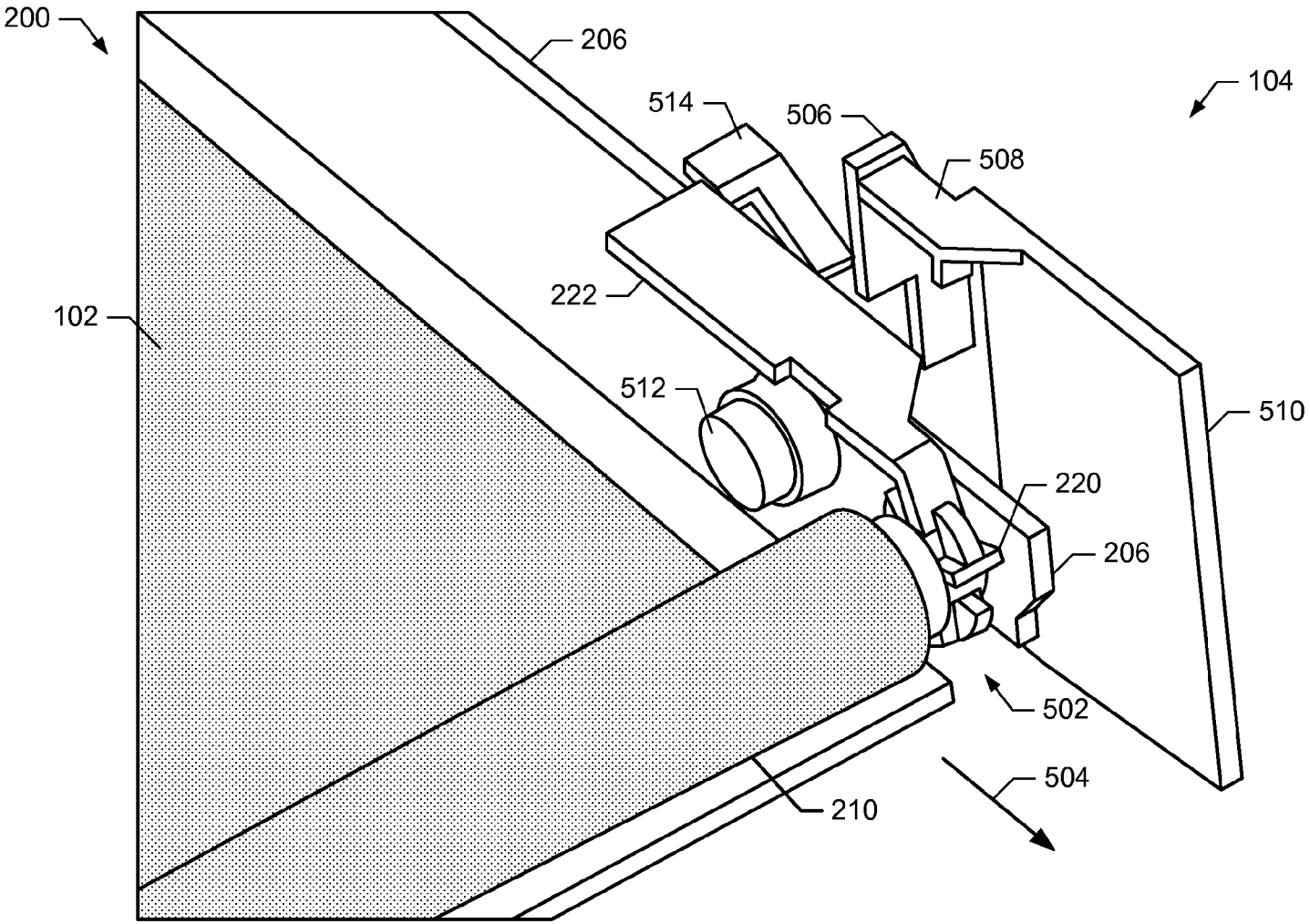
FIG. 5A illustrates a ratchet assembly for the example advancer of FIG. 1 showing the ratchet assembly in a rearward position.

FIG. 5A illustrates an example ratchet assembly 502 for the example advancer 104 of FIG. 1 in an example rearward position. The example ratchet assembly 502 of FIG. 5A incrementally rotates the cleaning roller 210 from a first position to a second position to position a fresh portion of cleaning material 102 adjacent a surface or structure to be cleaned in a cleaning procedure. In the example described below, the cleaning roller 210 is in the first position prior to the current cleaning operation and is advanced to the second position when the cleaning assembly 200 is advanced in a first direction 504 from the rearward position. The cleaning roller 210 is rotatably coupled to the housing 206.

The ratchet assembly 502 illustrated in FIG. 5A includes the ratchet wheel 220 and the pawl 222 of FIG. 2, a pawl actuator 506, and an actuator stop 508. The pawl actuator 506 is rotatably coupled to a bracket 510. The bracket 510 includes the actuator stop 508. The stop 508 operates to limit the pivot range of the pawl actuator 506. The example bracket 510 of FIG. 5A is similar to, but on an opposite side of the assembly 200 from, the example bracket 208 of FIG. 2. In particular, the bracket 510 supports the cleaning assembly 200. Thus, the cleaning assembly 200, the ratchet wheel 220, and the pawl 222 move relative to the brackets 208 and 510.

In the rearward position of FIG. 5A, the pawl 222 of the illustrated example engages (e.g., locks) the ratchet wheel 220, which prevents the ratchet wheel 220 and, thus, the cleaning roller 210 from rotating in either angular direction. The pawl 222 of the illustrated example is rotatably coupled to the housing 206 via a pawl hinge pin 512 defining the axis of rotation. The pawl 222 may engage and/or disengage from the ratchet wheel 220 by rotating about the pawl hinge pin 512. The pawl 222 of the illustrated example also includes an actuator tab 514, which is positioned at an angle relative to the pawl 222. When the actuator tab 514 contacts the pawl actuator 506, the pawl actuator 506 exerts a force on the actuator tab 514, which causes the pawl 222 to rotate about the pawl hinge pin 512 and disengage from the ratchet wheel 220. The actuator tab 514 also exerts a force on the pawl actuator 506, but the pawl actuator 506 is prevented from pivoting by the actuator stop 508.

Figure 5B:
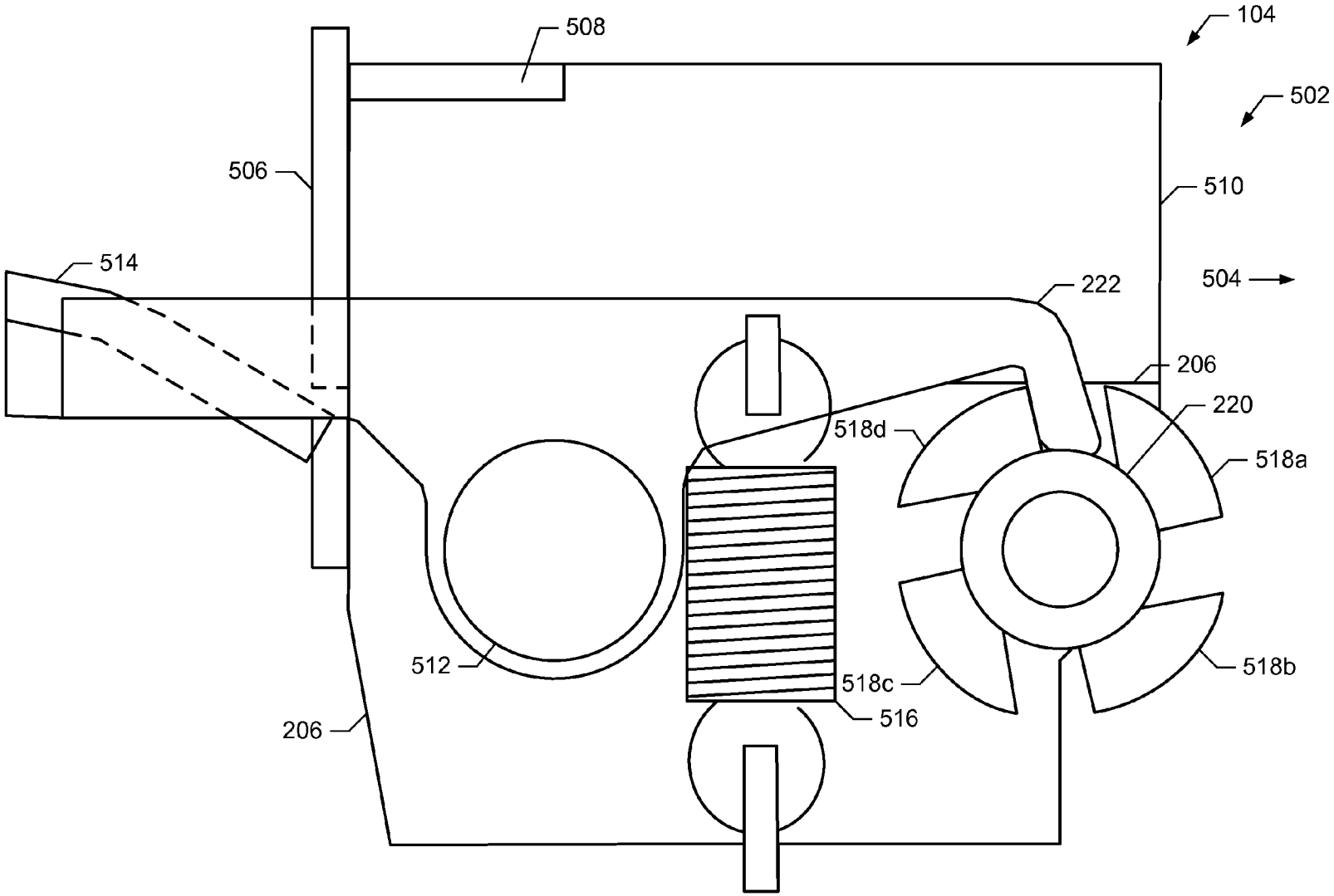
FIG. 5B is a side view of the example ratchet assembly of FIG. 5A in the rearward position of FIG. 5A.

FIG. 5B is a side view of the example ratchet assembly 502 of FIG. 5A in the rearward position of FIG. 5A. As shown in FIG. 5B, a tension spring 516 is coupled to the pawl 222 and to the housing 206. The tension spring 516 of the illustrated example provides a force on the pawl 222 to urge the pawl 222 into a locking engagement with the ratchet wheel 220. However, the force generated by the tension spring 516 is overcome by interaction of the actuator tab 514 and the pawl actuator 506 (e.g., via movement of the cleaning assembly 200 in the first direction 504) to disengage the pawl 222 from the ratchet wheel 220.

As illustrated in FIG. 5B, the ratchet wheel 220 of the illustrated example includes several teeth 518*a*, 518*b*, 518*c*, 518*d*. The example teeth 518*a*-518*d* are configured to mate with an end of the pawl 222 to substantially prevent rotation of the ratchet wheel 220 and, thus, the cleaning roller 210 in either direction. With the ratchet wheel 220 locked in both directions, the cleaning roller 210 may scrub a printer surface in multiple directions with little or no slippage (e.g., advancement or retraction) of the cleaning material 102.

Figure 5C:
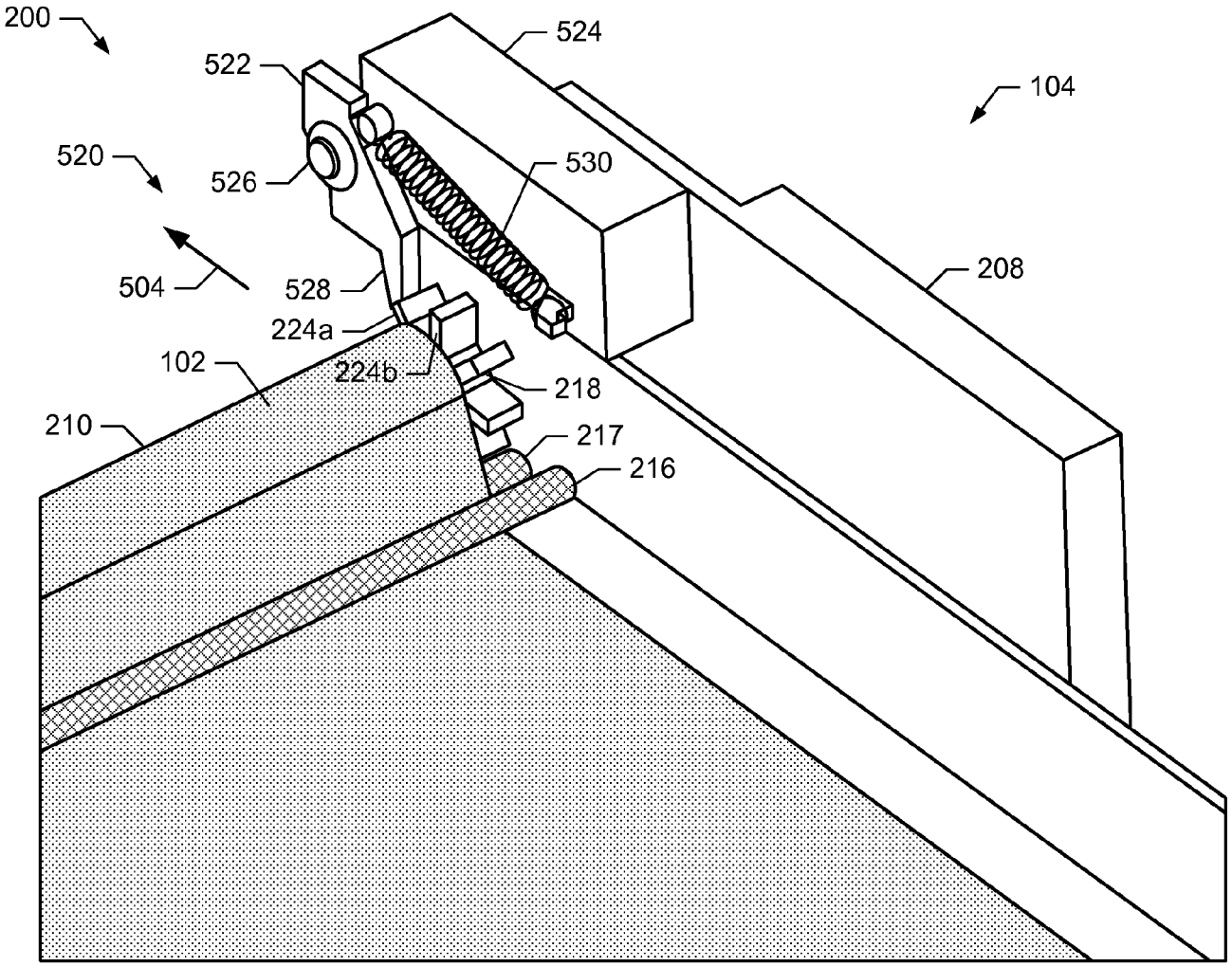
FIG. 5C illustrates an indexing gear assembly for the example advancer of FIG. 1 in the rearward position of FIG. 5A.

FIG. 5C illustrates an indexing gear assembly 520 for the example advancer 104 in the rearward position of FIGS. 5A and 5B. The illustrated indexing gear assembly 520 includes the gear 218 of FIG. 2 and an indexer 522. The indexer 522 of the illustrated example is coupled to a bracket (e.g., the bracket 208 of FIG. 2) via a mounting block 524. In particular, the indexer 522 is rotatably coupled to the mounting block 524 via an indexer hinge pin 526. The indexer 522 includes an indexer tooth 528 positioned in the travel path of the gear 218 to contact a tooth (e.g., tooth 224*a*, 224*b*, etc.) of the gear 218 to advance the cleaning material 102 when the cleaning assembly 200 is advanced in the first direction 504 and the ratchet wheel 220 is disengaged from the pawl 222.

Figure 5D:
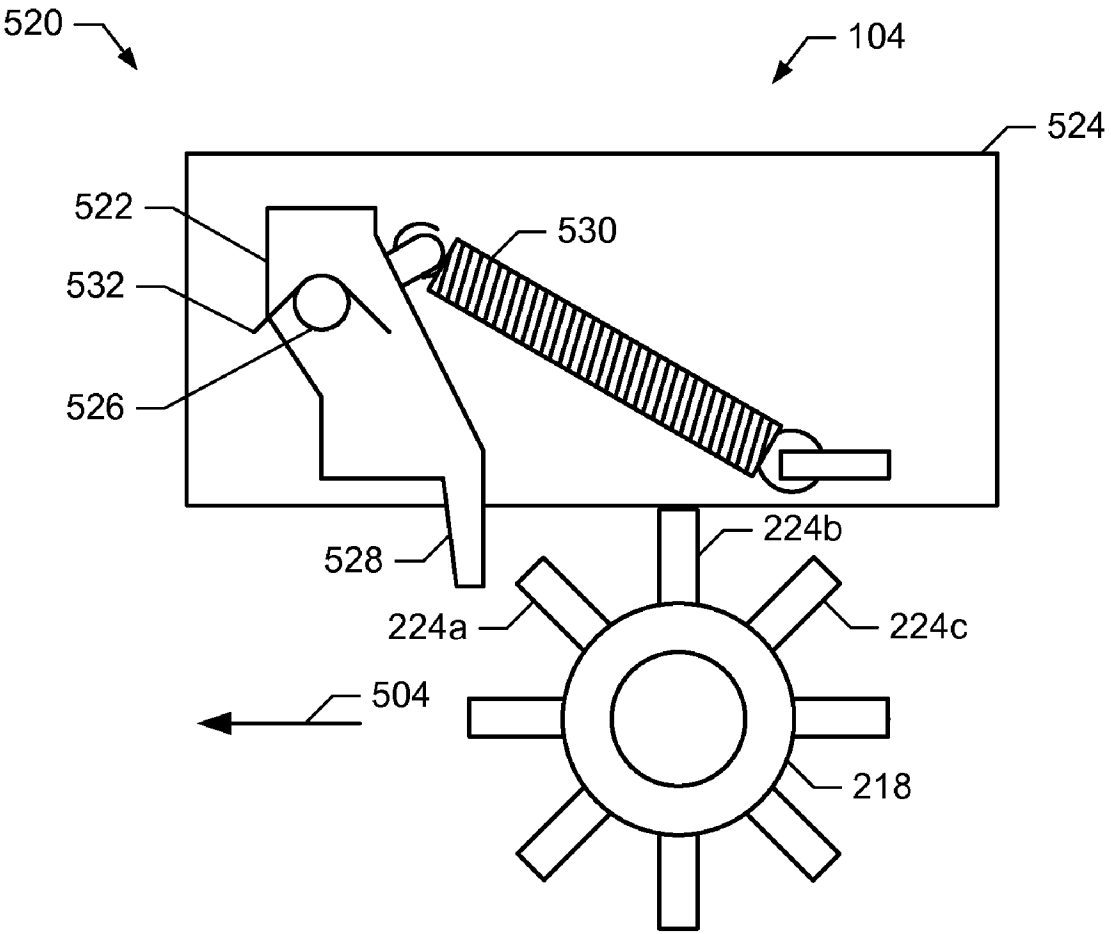
FIG. 5D is a side view of the example indexing gear assembly of FIG. 5C in the rearward position of FIG. 5A.

FIG. 5D is side view of the example indexing gear assembly 520 of FIG. 5C in the rearward position. As illustrated in FIG. 5D, the indexer 522 is coupled to the mounting block 524 via a tension spring 530 and a torsion spring 532. The example tension spring 530 urges the indexer 522 in a clockwise direction. In contrast, the torsion spring 532 urges the indexer 522 in a counterclockwise direction. In some examples, one or both of the springs 530 and 532 do not apply a force to the indexer 522 when the indexer 522 is in a neutral position, such as the position illustrated in FIGS. 5C and 5D. The operation of the springs 530 and 532 will be described in more detail below in conjunction with FIGS. 6C, 6D, 7C, 7D, and 8C.

Figure 6A:
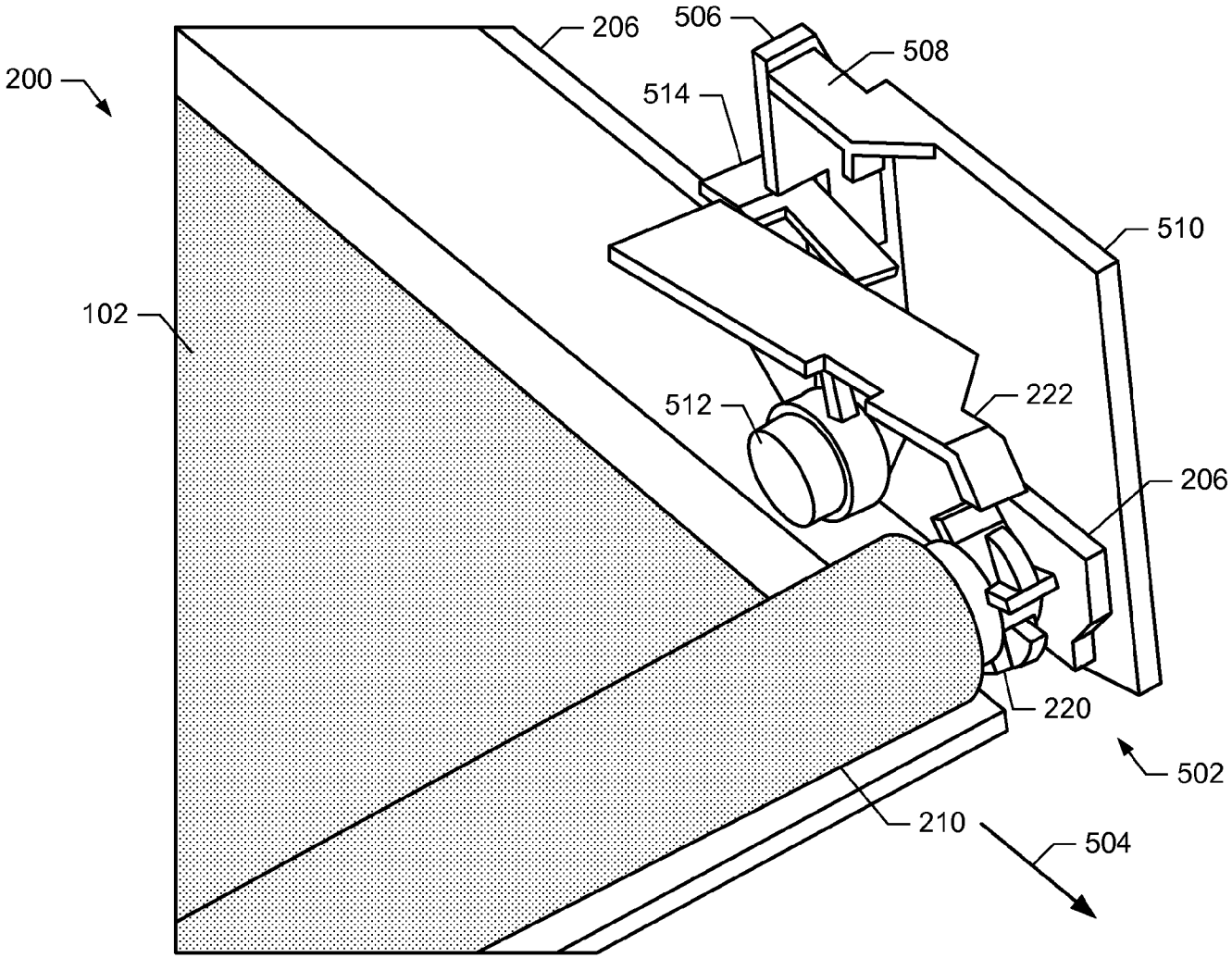
FIG. 6A illustrates the ratchet assembly of FIG. 5A in a ratchet release position.
Figure 6B:
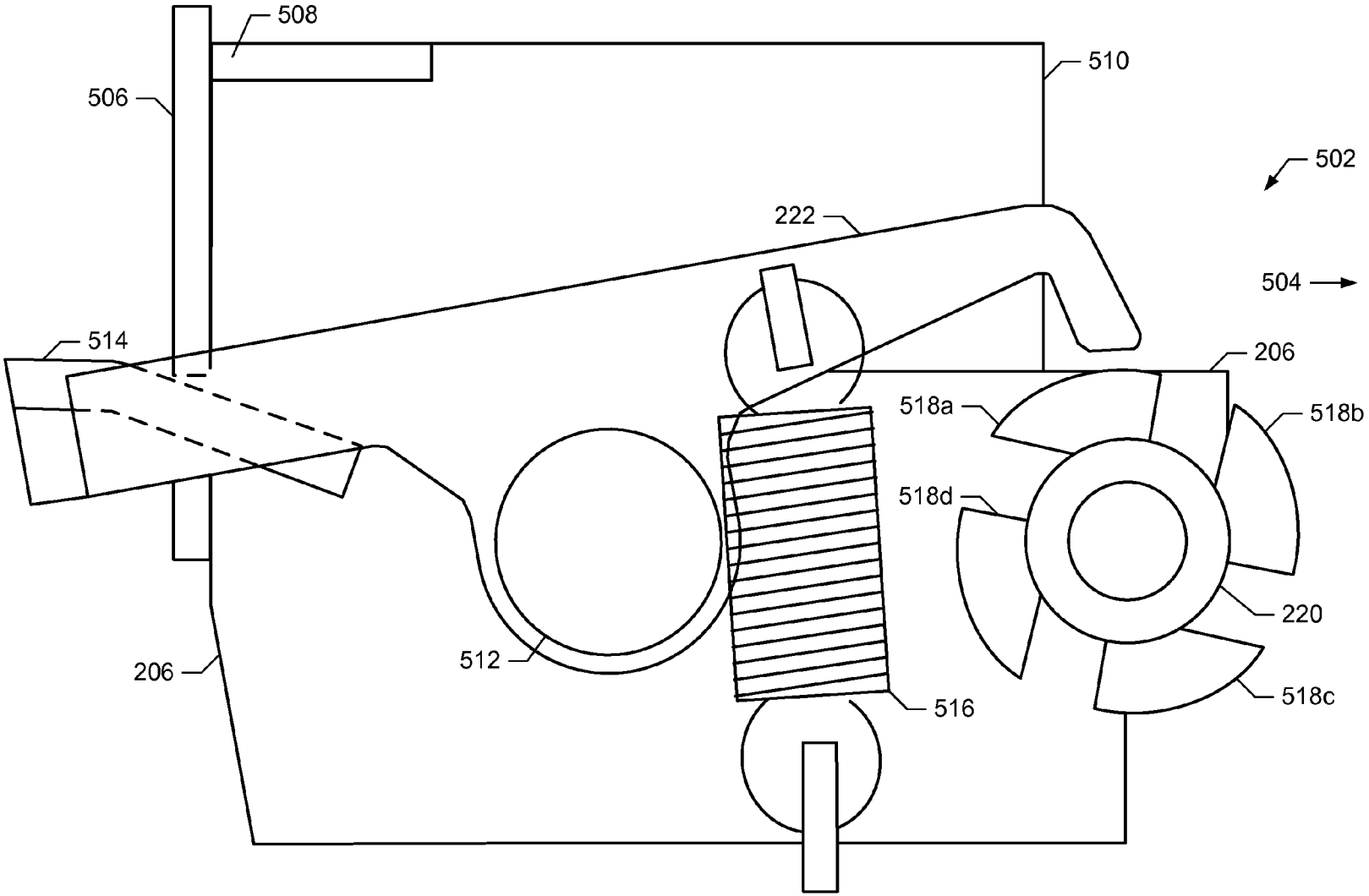
FIG. 6B is a side view of the example ratchet assembly of FIG. 5A with the ratchet assembly in the ratchet release position of FIG. 6A.

FIG. 6A illustrates the ratchet assembly 502 of FIG. 5A in a ratchet release position. In this position, the ratchet wheel 220 is free to rotate to advance the cleaning material 102. FIG. 6B is a side view of the example ratchet assembly 502 of FIG. 5A in the ratchet release position. In FIGS. 6A-6D, the cleaning assembly 200 has advanced in the first direction 504 relative to the rearward position of FIGS. 5A-5D. As a result, the cleaning assembly 200, the ratchet wheel 220, and the pawl 222 have moved relative to the pawl actuator 506 and the bracket 510. As illustrated in FIG. 6A, the actuator tab 514 is in contact with the pawl actuator 506 and has translated the movement of the cleaning assembly 200 in the first direction 504 (e.g., moving the actuator tab 514 into contact with the pawl actuator 506) into a rotational movement of the pawl 222 about the pawl hinge pin 512. The rotational movement by the pawl 222 causes the pawl 222 to disengage from the ratchet wheel 220. As a result, the cleaning roller 210 is free to rotate in response to, for example, turning of the gear 218.

Figure 6C:
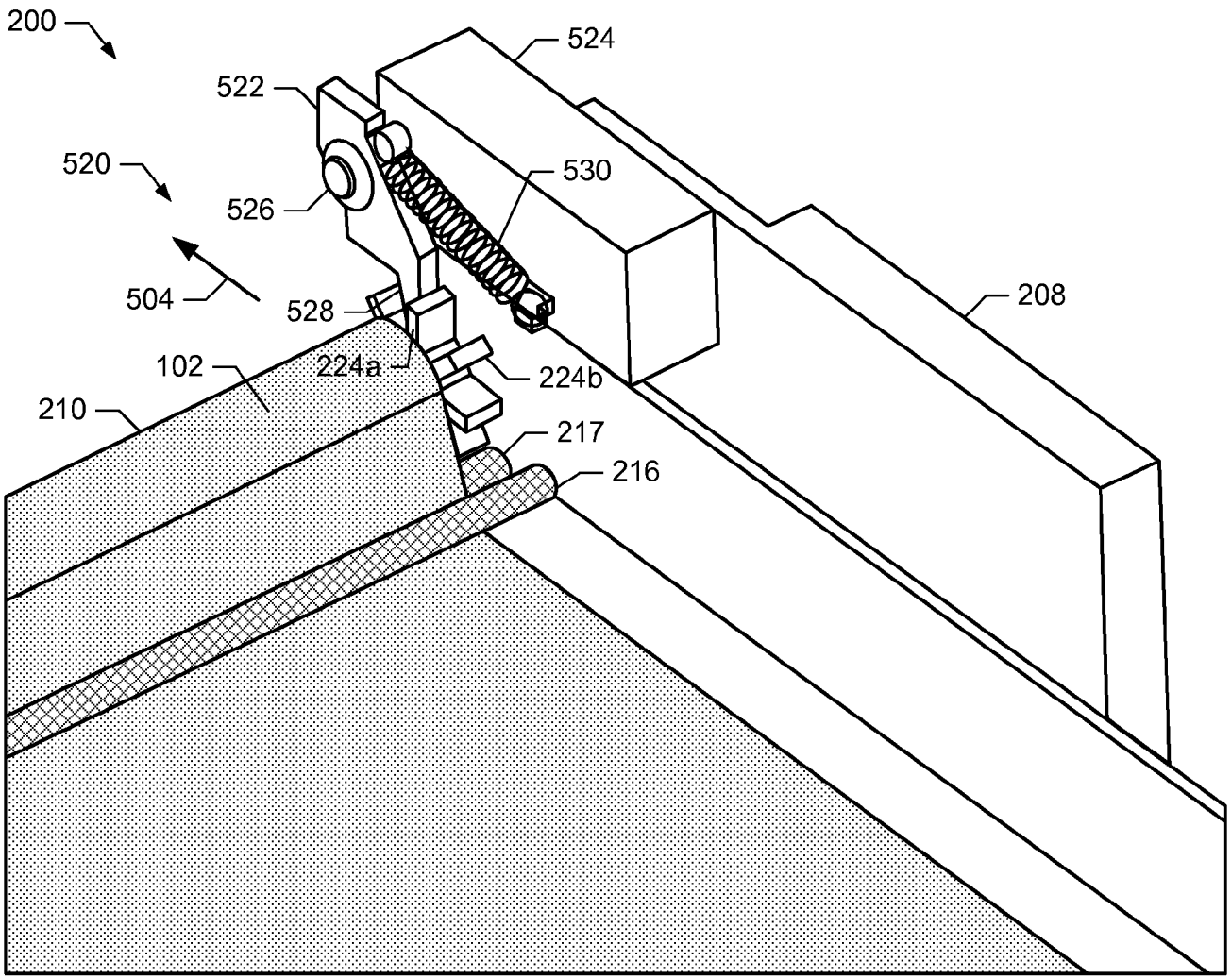
FIG. 6C illustrates the indexing gear assembly of FIG. 5C in the ratchet release position of FIG. 6A.
Figure 6D:
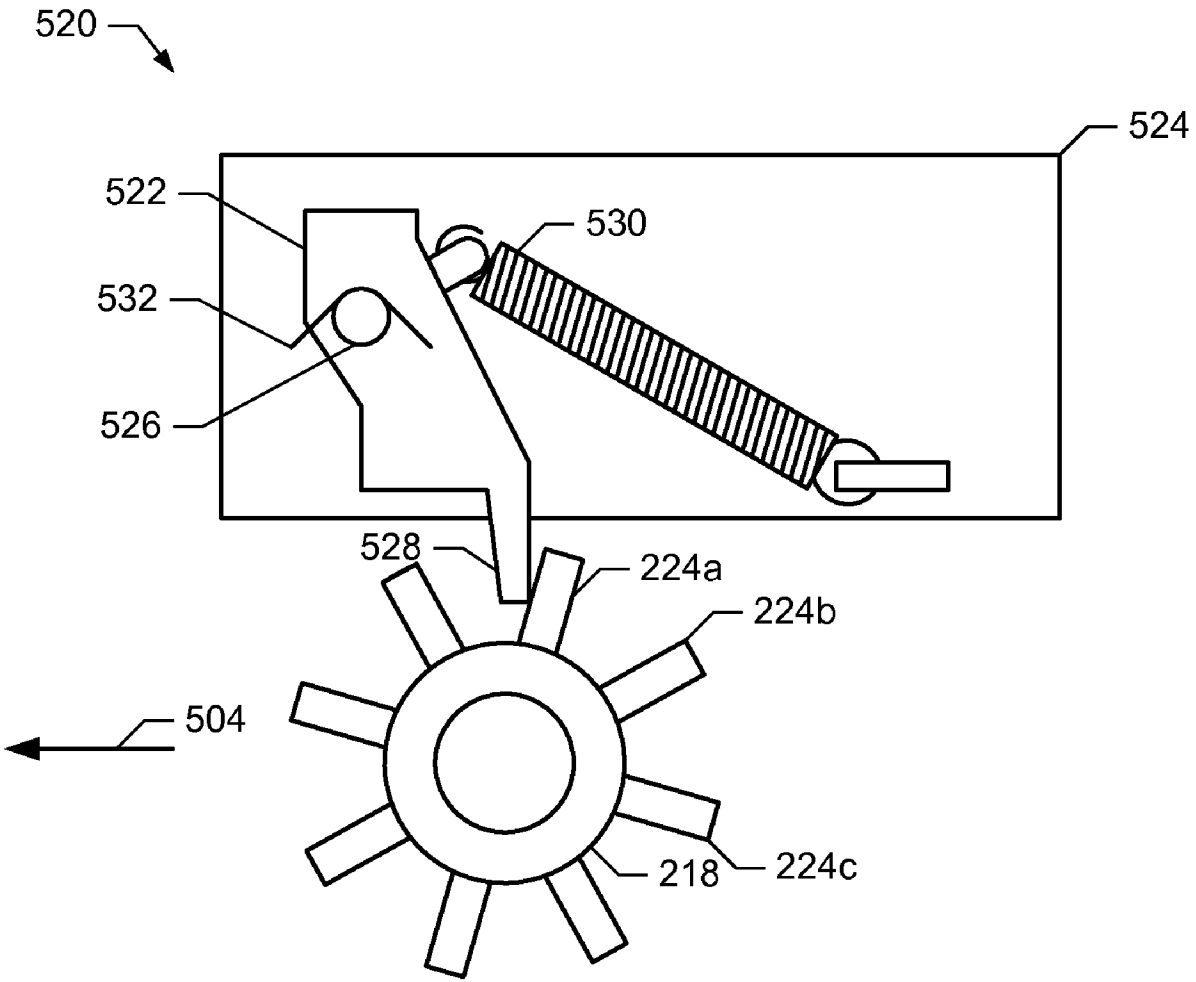
FIG. 6D is a side view of the example indexing gear assembly of FIG. 5C in the ratchet release position of FIG. 6A.

FIG. 6C illustrates the indexing gear assembly 520 of FIG. 5C in the ratchet release position of FIGS. 6A and 6B. FIG. 6D is a side view of the example indexing gear assembly 520 of FIG. 5C in the same ratchet release position. In the examples of FIGS. 6C and 6D, the indexer tooth 528 contacts the tooth 224*a* of the gear 218 and, because the pawl 222 has disengaged the ratchet wheel 220, turns the gear 218, the cleaning roller 210, and the ratchet wheel 220 as the cleaning assembly 200 advances in the first direction 504. The gear 218 also applies a force to the indexer tooth 528 to urge the indexer 522 to rotate in the clockwise direction about the indexer hinge pin 526. However, the torsion spring 532 is sufficiently dimensioned to resist rotation of the indexer 522 so that the indexer 522 rotates the gear 218.

Figure 7A:
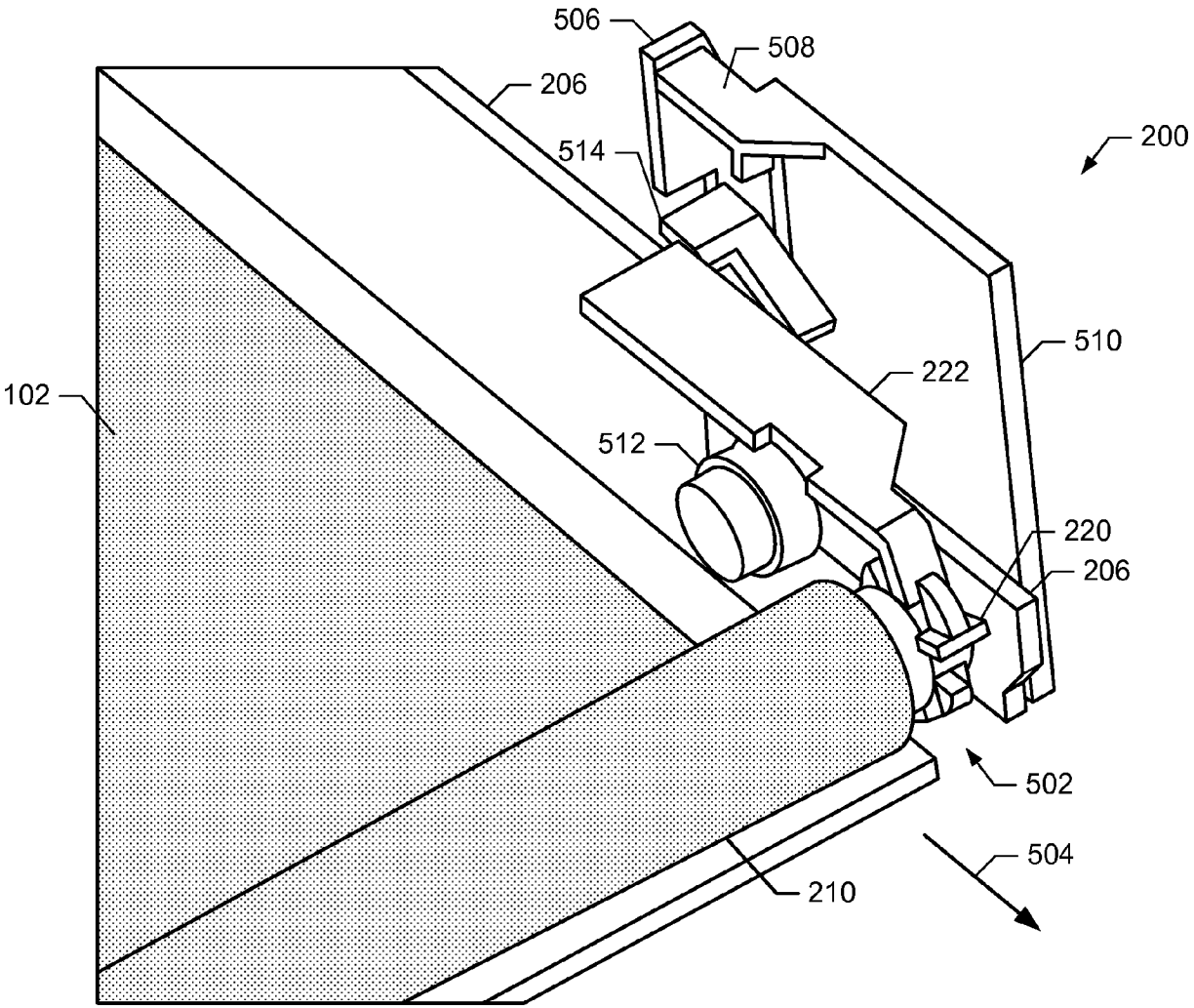
FIG. 7A illustrates the ratchet assembly of FIG. 5A in an extended position to secure the cleaning material in a second position.
Figure 7B:
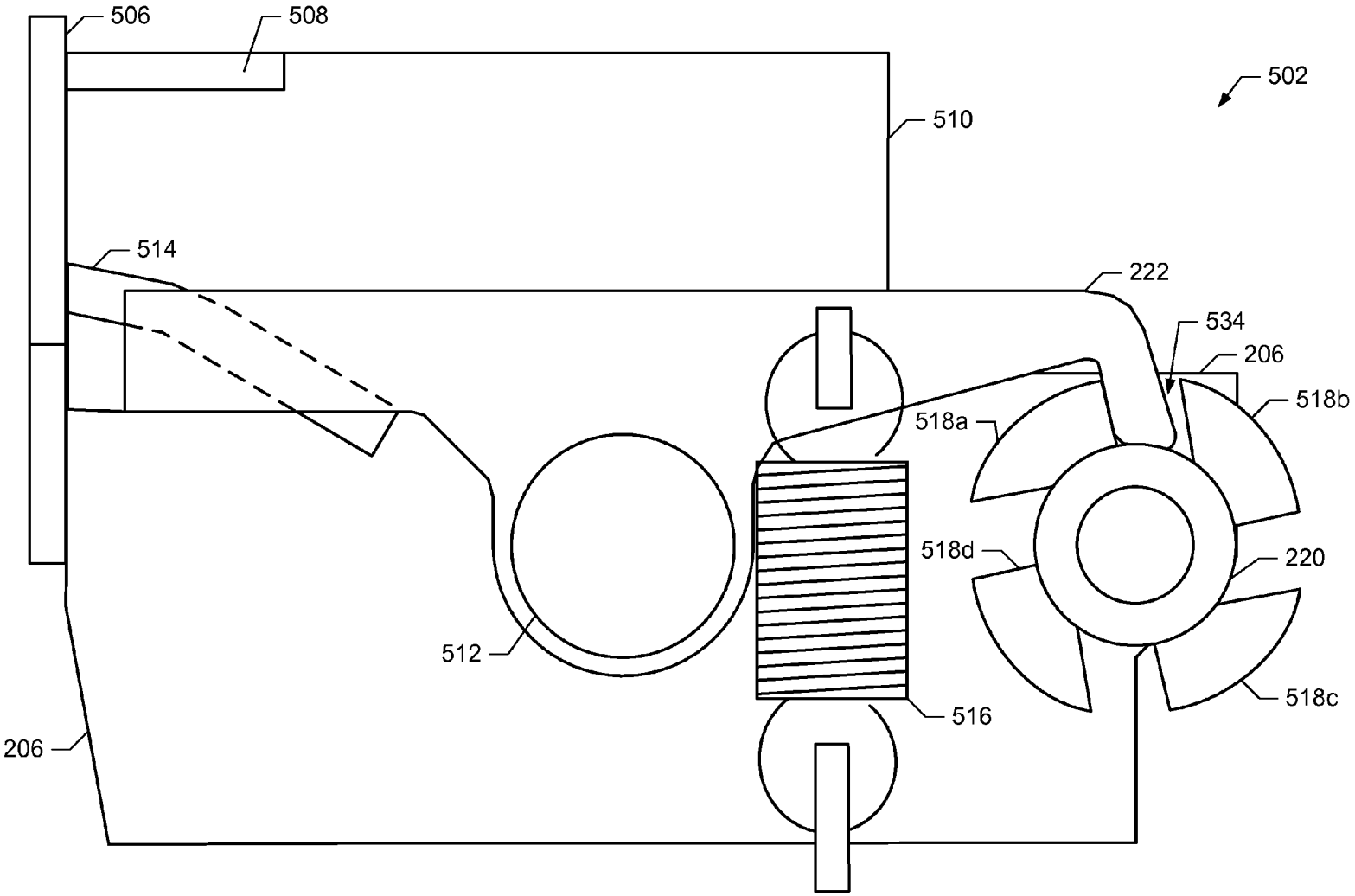
FIG. 7B is a side view of the ratchet assembly of FIG. 5A in the extended position of FIG. 7A.

FIG. 7A illustrates the example ratchet assembly 502 of FIG. 5A in an extended position with the cleaning material 102 secured (e.g., held) in a second position. FIG. 7B is a side view of the example ratchet assembly 502 of FIG. 5A in the extended position. In FIGS. 7A-7D, the cleaning assembly 200 has advanced in the first direction 504 relative to the ratchet release position shown in FIGS. 6A-6D. As illustrated in FIG. 7A, the actuator tab 514 has been advanced past the pawl actuator 506. The spring 516 thus urges the pawl 222 into locking engagement with the ratchet wheel 220. In particular, the pawl 222 is moves into a groove 534 between two of the teeth (e.g., teeth 518*a*-518*d*). As a result, the pawl 222 engages with and locks the ratchet wheel 220, substantially preventing further rotation of the cleaning roller 210. However, if the pawl 222 is brought into contact with an outer surface of a tooth 518*a*-518*d*, the cleaning roller 210 may continue to rotate until a groove (e.g., the groove 534) between two teeth (e.g., any adjacent pair of teeth 518*a*-518*d*) aligns with the tip of the pawl 222. Upon the occurrence of the alignment, the pawl 222 is urged into the groove 534 by the spring 516 and locks the ratchet wheel 220.

Figure 7C:
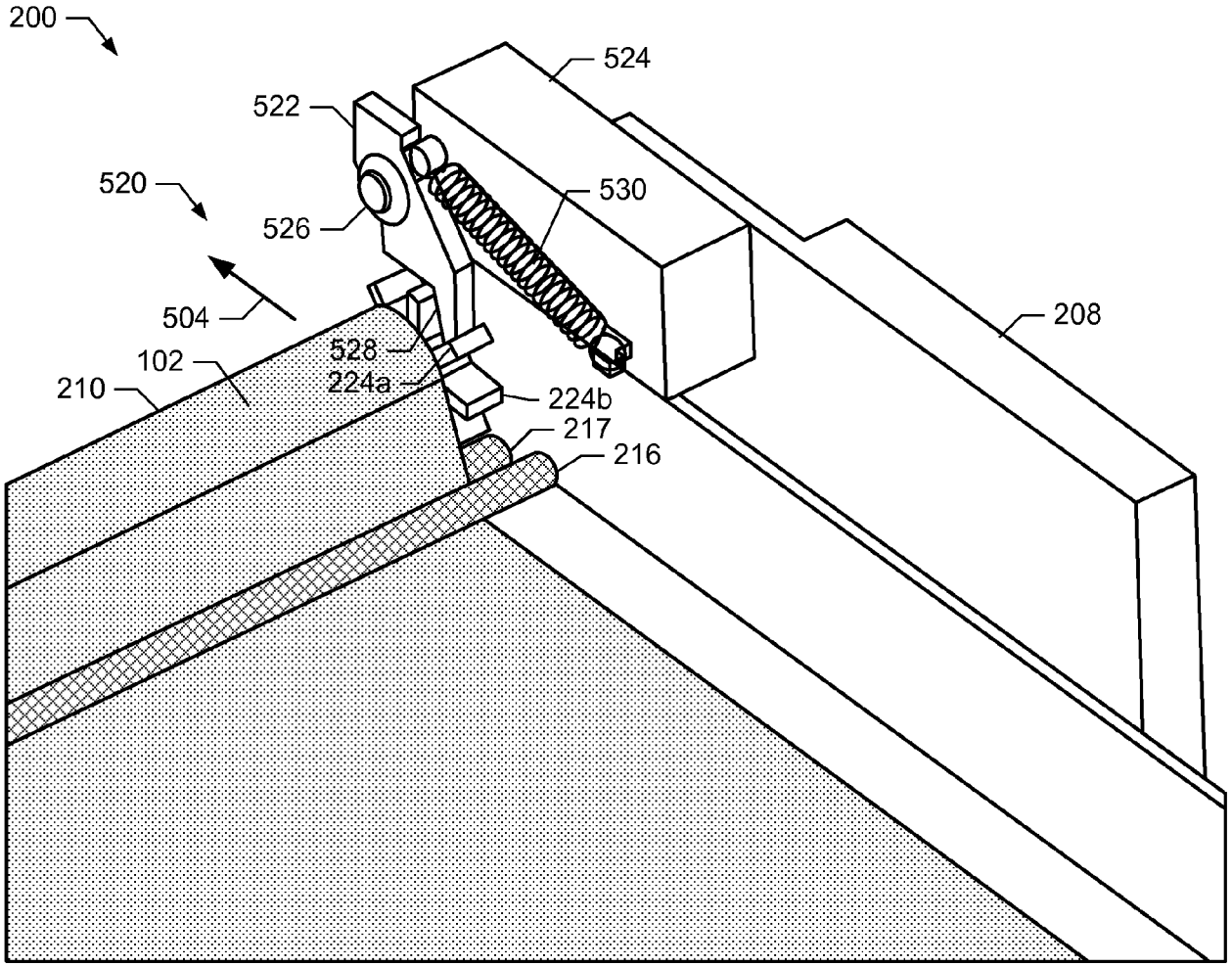
FIG. 7C illustrates the indexing gear assembly of FIG. 5C in the extended position of FIG. 7A.
Figure 7D:
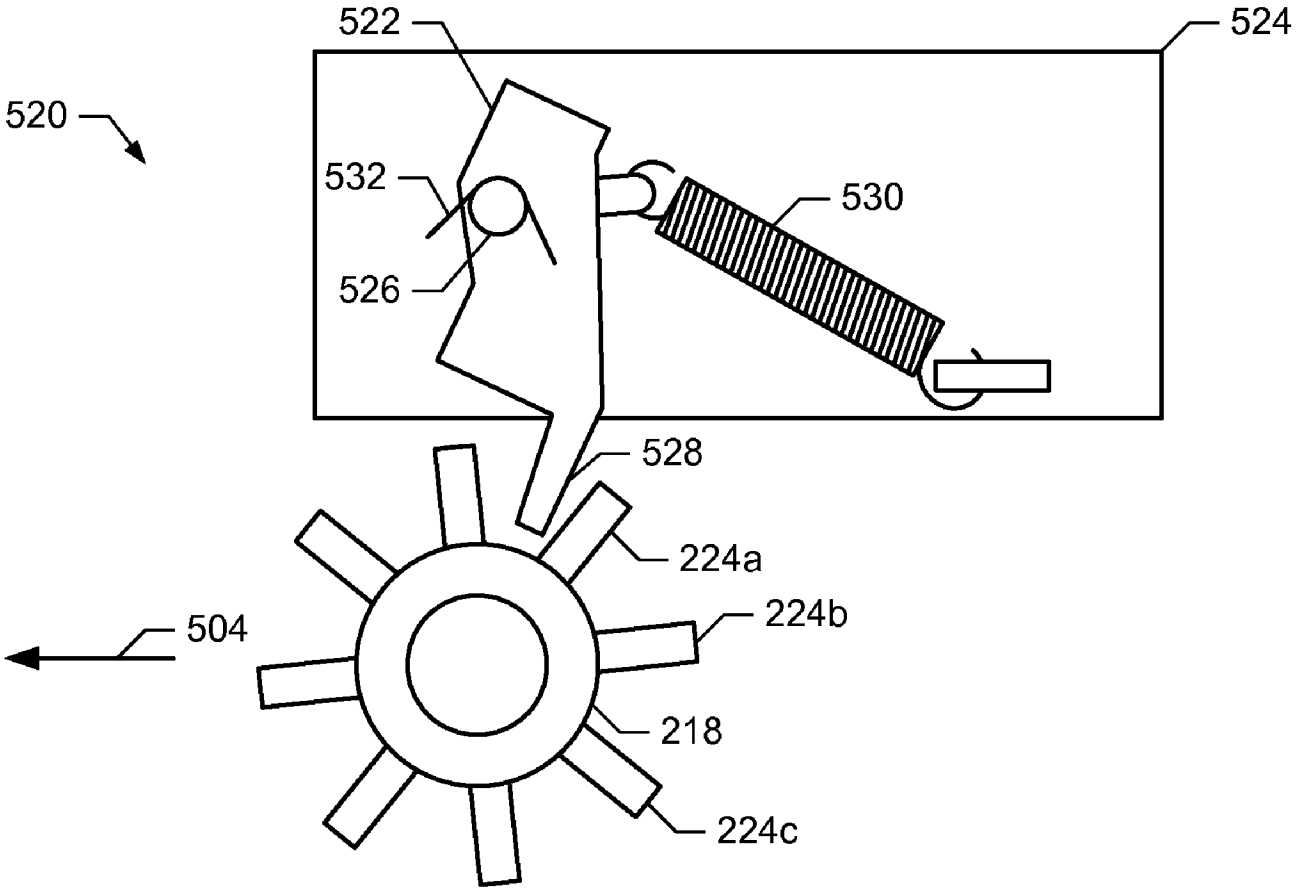
FIG. 7D is a side view of the example indexing gear assembly of FIG. 5C in the extended position.
Figure 8A:
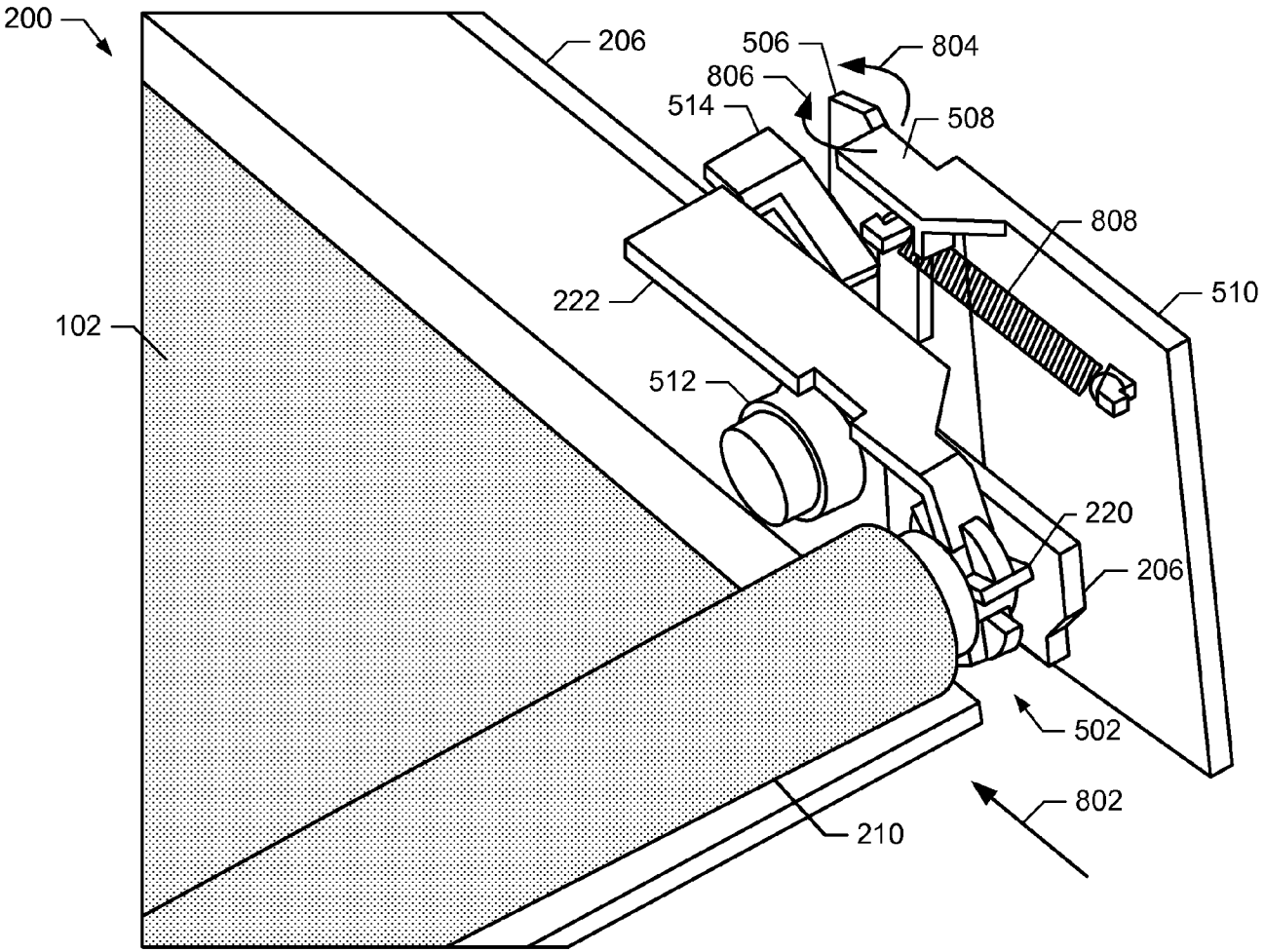
FIG. 8A illustrates the example ratchet assembly of FIG. 5A in a retracting position as the cleaning sled of FIG. 2 retracts.
Figure 8B:
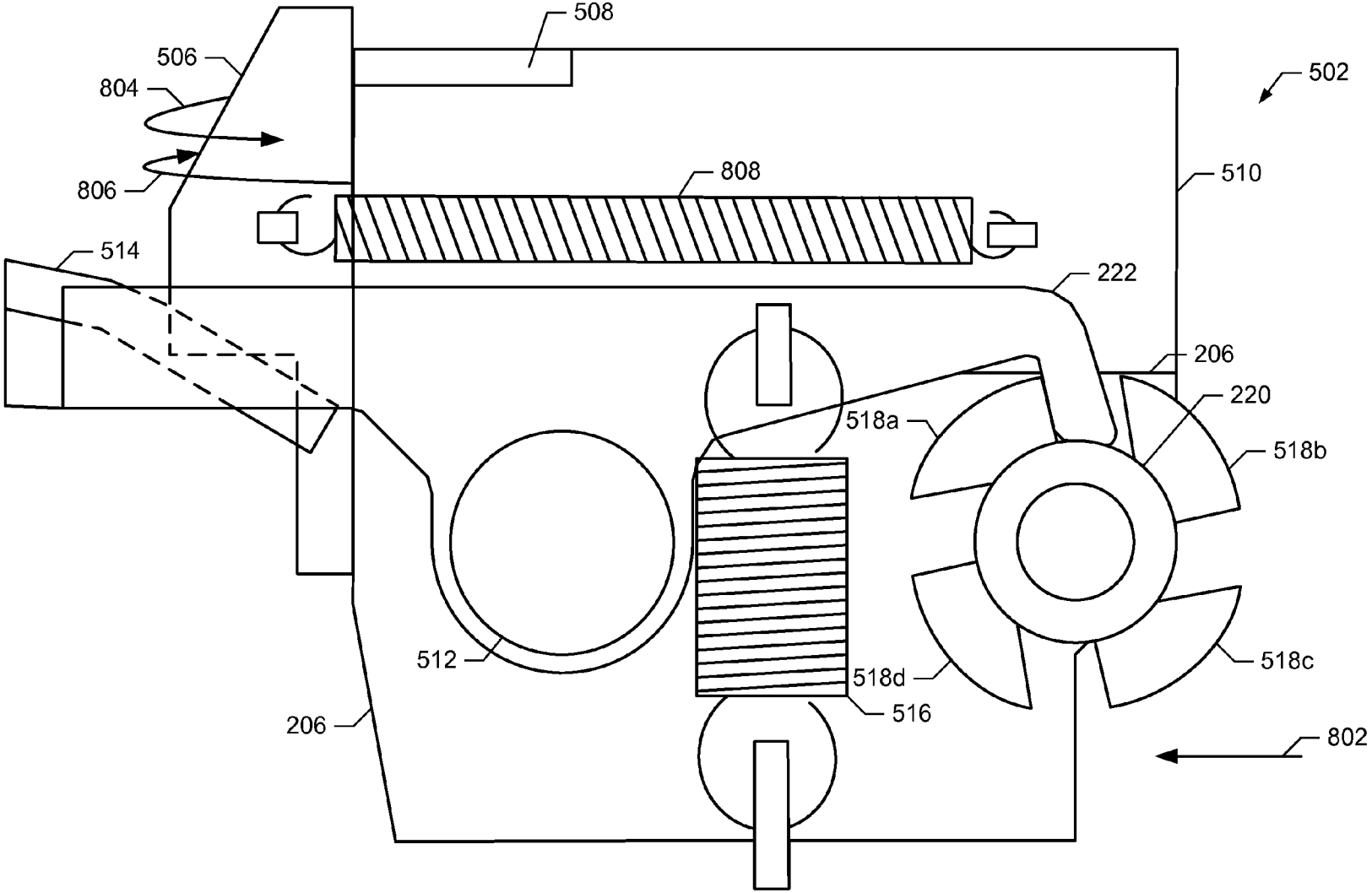
FIG. 8B is a side view of the example ratchet assembly of FIG. 5A in the retracting position of FIG. 8A.
Figure 8C:
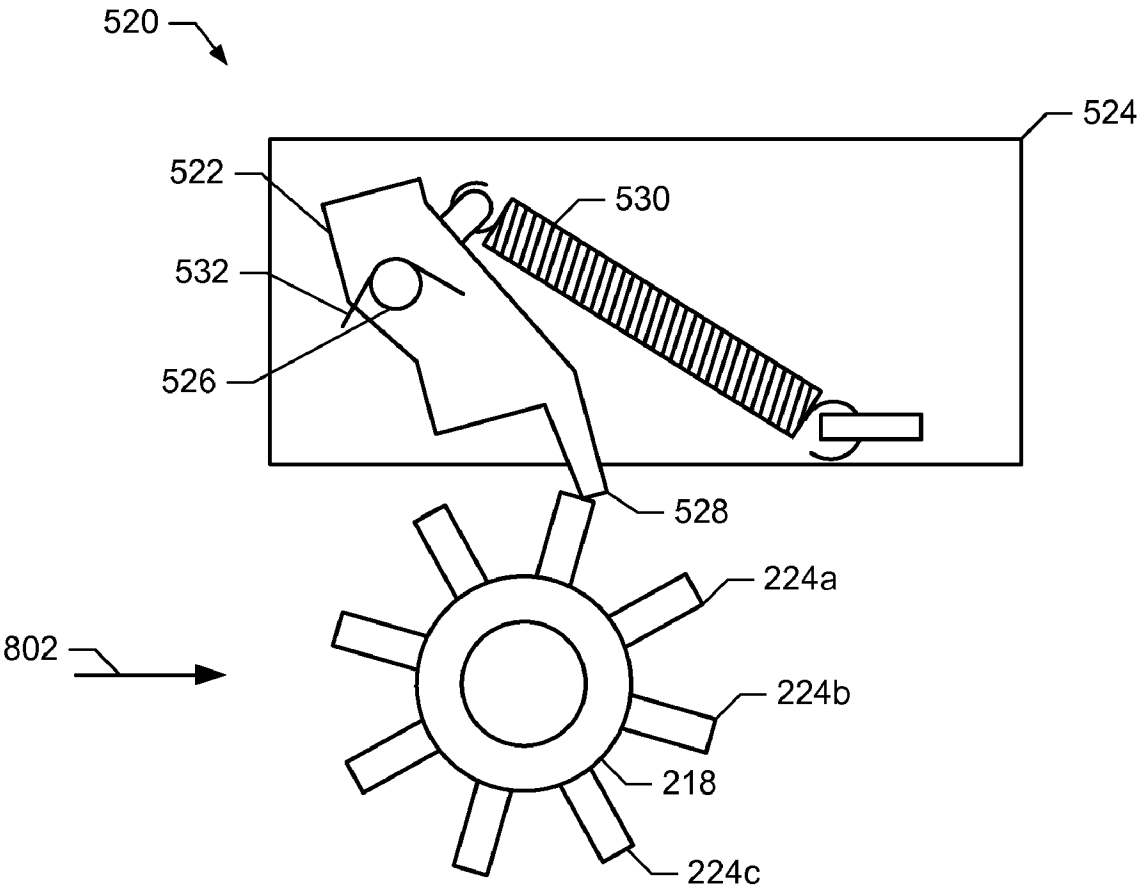
FIG. 8C illustrates the example indexing gear assembly of FIG. 5C in the retracting position of FIG. 8A.

FIG. 7C illustrates the indexing gear assembly 520 of FIG. 5C in the extended position of FIGS. 7A and 7B. FIG. 7D is a side view of the example indexing gear assembly 520 of FIG. 5C in the extended position. As discussed above, the ratchet wheel 220 is locked in FIGS. 7C and 7D, thereby substantially preventing rotation of the cleaning roller 210 and the gear 218. While the indexer tooth 528 remains in contact with the example tooth 224*a*, since the tooth 224*a* is locked against rotation by the pawl 222, the tooth 224*a* forces the indexer 522 to rotate clockwise (in the view of FIG. 7D) to allow the gear 218 to slip past the indexer 522 as the cleaning assembly 200 continues to move in the first direction 504. The torsion spring 532 urges the indexer 522 into a neutral position when the indexer 522 is no longer in contact with the gear 218.

FIGS. 8A, 8B, and 8C illustrate the example cleaning assembly 200, ratchet assembly 502, and indexing gear assembly 520 in a retracting position. In the retracting position, the cleaning assembly 200 may have completed a cleaning procedure and is retracting in a second direction 802 opposite the first direction 504.

FIG. 8A illustrates the example ratchet assembly 502 of FIG. 5A in the retracting position as the cleaning assembly 200 is moving in the second direction 802. FIG. 8B is a side view of the example ratchet assembly 502 of FIG. 5A in the retracting position. As described above, the example pawl actuator 506 is pivotally coupled to the bracket 510. The actuator stop 508 limits the pivot range of the pawl actuator 506 in a first pivot direction 804, but the pawl actuator 506 may pivot in a second pivot direction 806 opposite the first pivot direction 804. The example pawl actuator 506 may further be coupled to the bracket 510 via a tension spring 808 to urge the pawl actuator 506 in the first pivot direction 804. However, this tension force may be overcome by the actuator tab 514 when the cleaning assembly 200 is retracting in the second direction 802. In particular, the actuator tab 514 of the illustrated example pushes the pawl actuator 506, causing the pawl actuator 506 to pivot out of the way so that the cleaning assembly 200 may continue to retract. After the actuator tab 514 passes the pawl actuator 506, the tension spring 808 may urge the pawl actuator 506 to pivot in the first direction 804 until it contacts the actuator stop 508.

FIG. 8C illustrates the example indexing gear assembly 520 of FIG. 5C in the retracting position of FIGS. 8A and 8B as the cleaning assembly 200 of FIG. 2 is retracting in the second direction 802. As the cleaning assembly 200 retracts in the second direction 802, the gear 218 contacts the indexer 522. As discussed above, the ratchet wheel 220 is locked by the pawl 222, which substantially prevents the cleaning roller 210 and the gear 218 from rotating. To avoid damaging the indexer 522, the indexer tooth 528, the gear 218, and/or the gear teeth 224, the indexer 522 of the illustrated example pivots counterclockwise to move the indexer tooth 528 out of the path of the gear 218. After the gear 218 passes the indexer 522, the tension spring 530 urges the indexer 522 back to a neutral position.

While an example advancer 104 is described in FIGS. 5A-8C, other methods and/or mechanisms may be used to implement the advancer to incrementally advance and secure the cleaning material 102 to sequentially position portions of the cleaning material 102 for respective cleaning procedures. As an example, and not by way of limitation, the advancer 104 may include one or more electronic actuators to lock and unlock a ratchet, turn a cleaning roller and/or a gear, and/or advance and retract a cleaning sled. Additionally, while the example cleaning roller 210 of FIGS. 2 and 5A-8C is rotated in response to movement of the assembly 200 of FIG. 2 to cause the cleaning material 102 to advance, another roller in a cleaning material path may be selectively actuated (e.g., rotated) to advance the cleaning material 102 to the position the cleaning material 102 for a subsequent cleaning stage.

Figure 9:
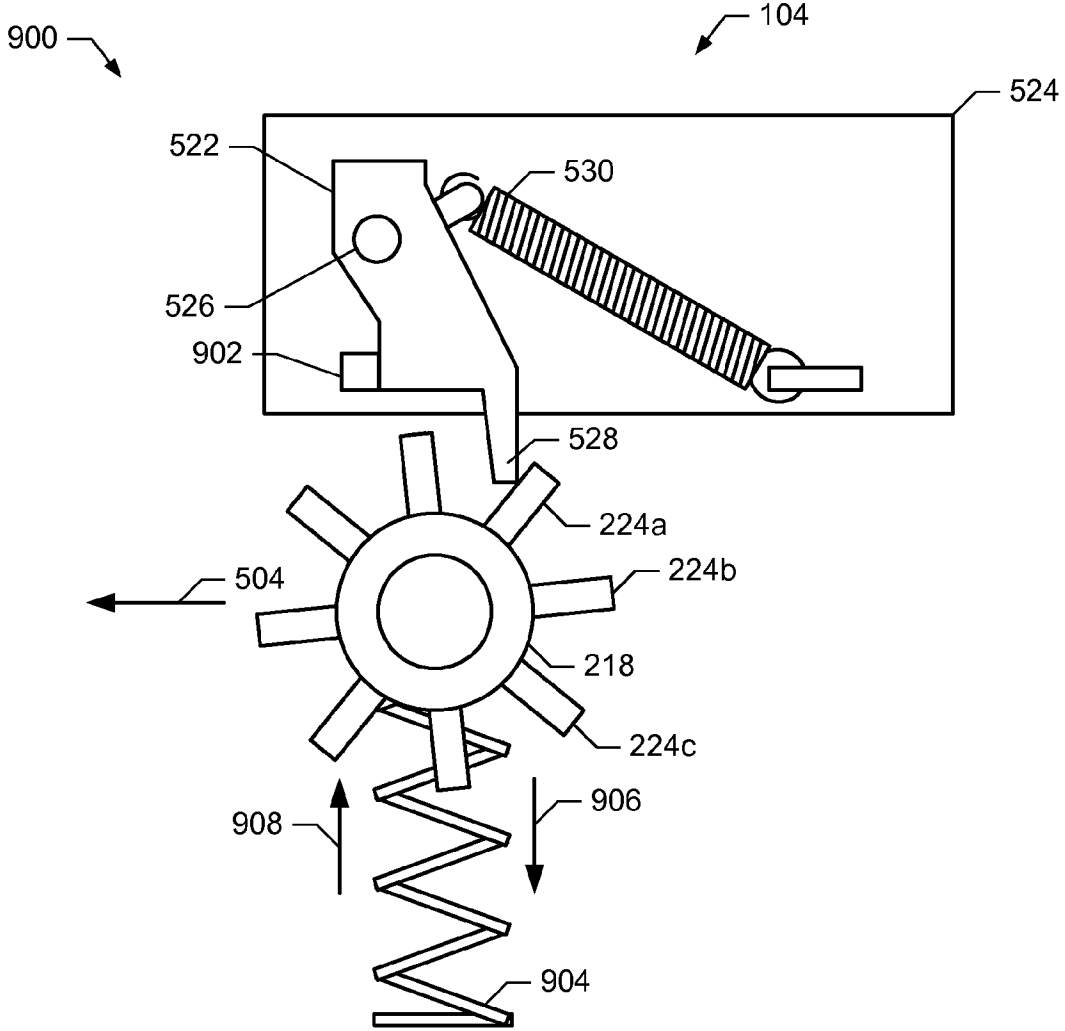
FIG. 9 is a side view of another example indexing gear assembly in the extended position illustrated in FIG. 7D.

FIG. 9 is a side view of another example indexing gear assembly 900 shown in the extended position illustrated in FIG. 7D. The example indexing gear assembly 900 of FIG. 9 may be used to implement the advancer 104 of FIG. 1 to advance the cleaning material 102. The indexing gear assembly 900 is illustrated in FIG. 9 in the example extended position illustrated in FIGS. 7A-7D, and includes the example gear 218, the example teeth 224*a*-224*c*, the example indexer 522, the example mounting block 524, the example indexer hinge pin 526, the example indexer tooth 528, and the example tension spring 530.

In contrast to the example indexing gear assembly 520 of FIGS. 5C-8C, the example indexing gear assembly 900 does not include the torsion spring 532. Instead, the indexing gear assembly 900 illustrated in FIG. 9 includes an indexer stop 902 on the mounting block 524 and a compression spring 904 coupled to the cleaning roller 210. The indexer stop 902 projects from the mounting block 524 to contact the indexer 522, thereby limiting clockwise rotation of the indexer 522. Once the indexer 522 reaches this limit of its rotation the tooth 224*a* may not rotate the indexer tooth 528 further as the gear 218 continues to translate in the first direction 504. The gear 218 is also secured against rotation in the extended position because, as shown in FIGS. 7A and 7B, the pawl 222 has locked the ratchet wheel 220. As shown in FIG. 9, the tooth 224*a* engages the indexer tooth 528 at a non-perpendicular angle. As a result, the tooth 224*a* acts as a camming surface such that engagement of the indexer tooth 528 and the tooth 224*a* causes the cleaning roller 210, the gear 218, and the teeth 224*a*-224*c* to translate in a compression direction 906 until the tooth 224*a* clears the indexer tooth 528. Once the tooth 224*a* clears the indexer tooth 528, the cleaning roller 210 may continue to extend in the first direction 504. Further, after the gear tooth 224*a* clears the indexer tooth 528, the compression spring 904 urges the cleaning roller 210 and the gear 218 in a decompression direction 908 opposite the compression direction 906 (e.g., toward a neutral position).

The example printer cleaning assemblies, advancers, and cleaning materials described above are implemented with a movable cleaning assembly where the surface to be cleaned is stationary. As a result, the movement (e.g., extension and retraction) of the cleaning assembly, advancer, and cleaning material results in a relative motion (e.g., scrubbing) between the cleaning material and the surface. However, in some other example printers, the printer cleaning assembly, advancer, and/or cleaning material may be stationary as the surface to be cleaned (e.g., a scanning print head) moves, which may also result in a relative motion between the cleaning material and the surface.

For example, if the cleaning assembly 200, the housing 206, and the cleaning roller 210 illustrated in FIGS. 5A-8C are stationary relative to the printer, the brackets 208 and 510, the pawl actuator 506, the actuator stop 508, the tension spring 808, the indexer 522, the mounting block 524, the indexer hinge pin 526, the indexer tooth 528, the tension spring 530, and the torsion spring 532 of FIGS. 5A-8C move in the second direction 804 to advance the cleaning material 102, resulting in a relative motion equivalent to moving the cleaning assembly 200, the cleaning roller 210, the ratchet assembly 502, and the indexing gear assembly 520 in the first direction 504.

The movement of the brackets 208 and 510, the pawl actuator 506, the actuator stop 508, the tension spring 808, the indexer 522, the mounting block 524, the indexer hinge pin 526, the indexer tooth 528, the tension spring 530, the torsion spring 532 and/or, more generally, the advancer 104 may be driven by the movement of the surface 306 to be cleaned (e.g., scanning movement of a print head) from a retracted position to an extended position. For example, the surface 306 may reciprocate between the retracted position (e.g., a printing position if the surface 306 is a print head) and the extended position (e.g., a cleaning position if the surface 306 is a print head) while the cleaning assembly 200 and/or the housing 206 of FIG. 2 are stationary relative to the printer, where the cleaning material 102 is in contact with the surface 306 when the surface 306 is in an extended position.

Figure 10B:
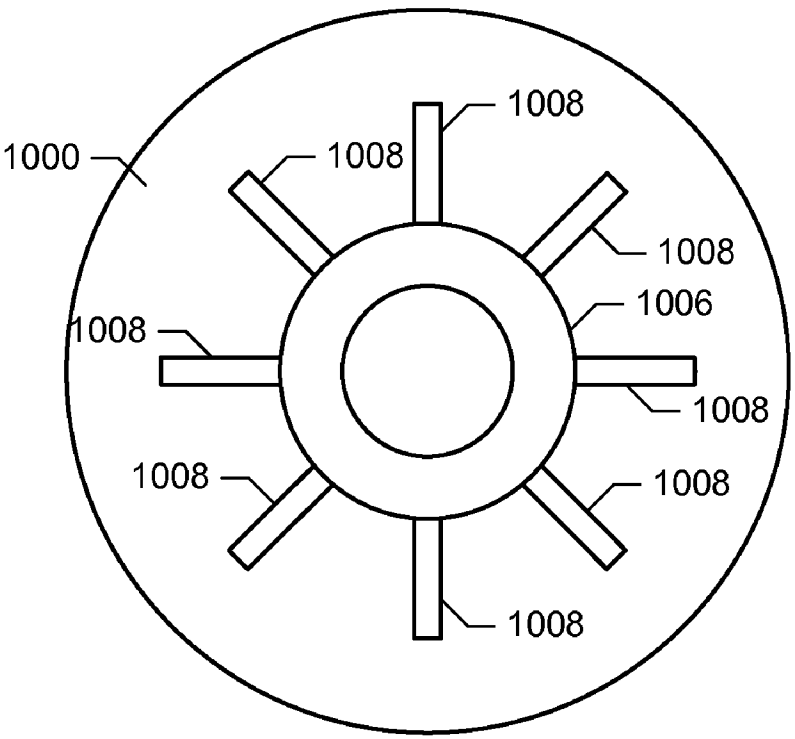
FIGS. 10A and 10B illustrate example ratchet and gear configurations for a cleaning surface.
Figure 10A:
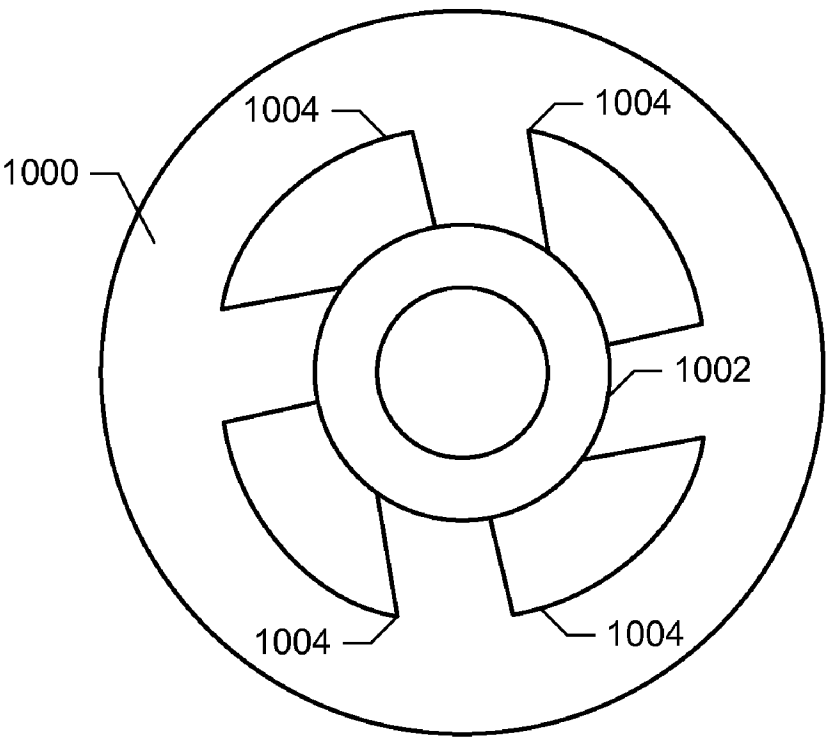

FIGS. 10A and 10B show opposite ends of an example roller 1000 that may be used as the cleaning roller 210 of FIG. 2. The roller 1000 illustrated in FIG. 10A includes a ratchet wheel 1002 including several teeth 1004. The roller 1000 illustrated in FIG. 10B includes a gear 1006 includes several teeth 1008 and is located at the opposite end of the roller 1000 from the ratchet wheel 1002. In general, the number and/or spacing of the teeth 1004 on the ratchet wheel 1002 and the number and/or spacing of the teeth 1008 on the gear 1006 may be based on a diameter of the roller 1000 and/or the amount of cleaning material used during a cleaning procedure (e.g., a width of the surface to be cleaned).

Figure 11B:
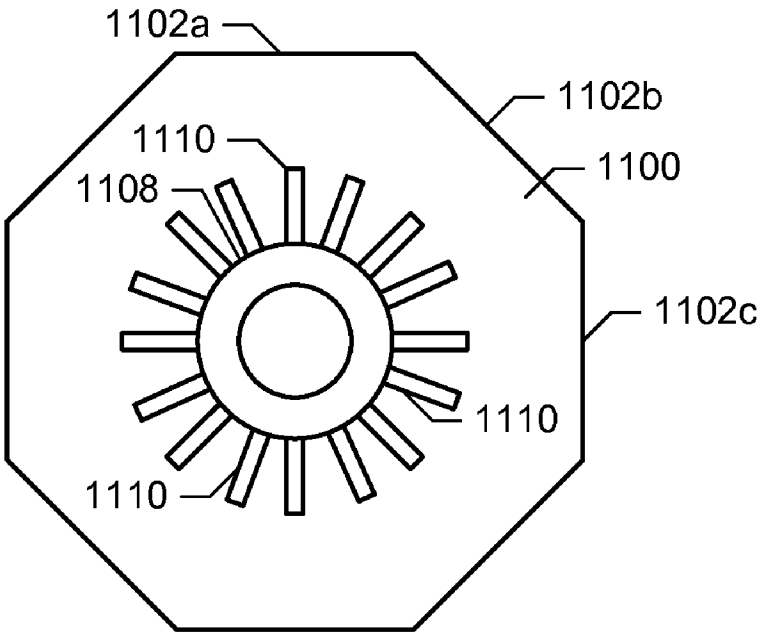
FIGS. 11A and 11B illustrate additional example ratchet and gear configurations for a cleaning surface.
Figure 11A:
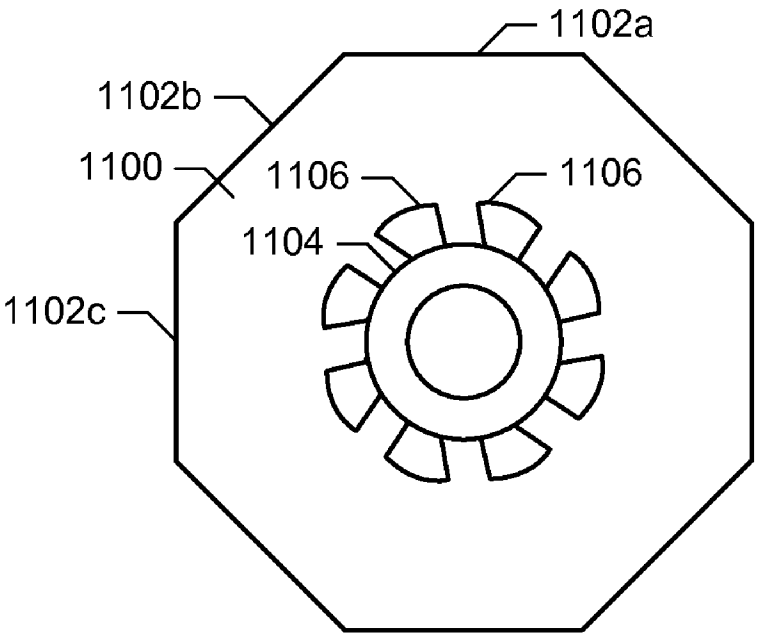

FIGS. 11A and 11B show opposite ends of another example roller 1100 that may be used as the cleaning roller 210 of FIG. 2. The example roller 1100 has several faces 1102*a*-1102*c* and a ratchet wheel 1104 with several teeth 1106. As illustrated in FIG. 11B, the example roller 1100 also includes a gear 1108 having several teeth 1110 and located at an opposite end of the roller 1100 from the ratchet wheel 1104. Compared to the example roller 1000 of FIGS. 10A and 10B, the example ratchet wheel 1104 and the example gear 1108 of FIGS. 11A and 11B include more ratchet teeth 1106 and more gear teeth 1110, which are also spaced more closely together. As a result, the example roller 1100 of FIGS. 11A and 11B may rotate less (angularly) when the cleaning material is to be advanced.

The example ratchet wheel 1104 illustrated in FIG. 11A is configured to advance the cleaning material by rotating the roller 1100, to cause the roller 1100 to position a second face subsequent to a first face at an orientation to clean a surface. For example, if a first face 1102*a* is used for a first cleaning procedure, the cleaning roller 1100 may be rotated to position the second face 1102*b* for the next cleaning procedure.

Figures 12A, 12B:
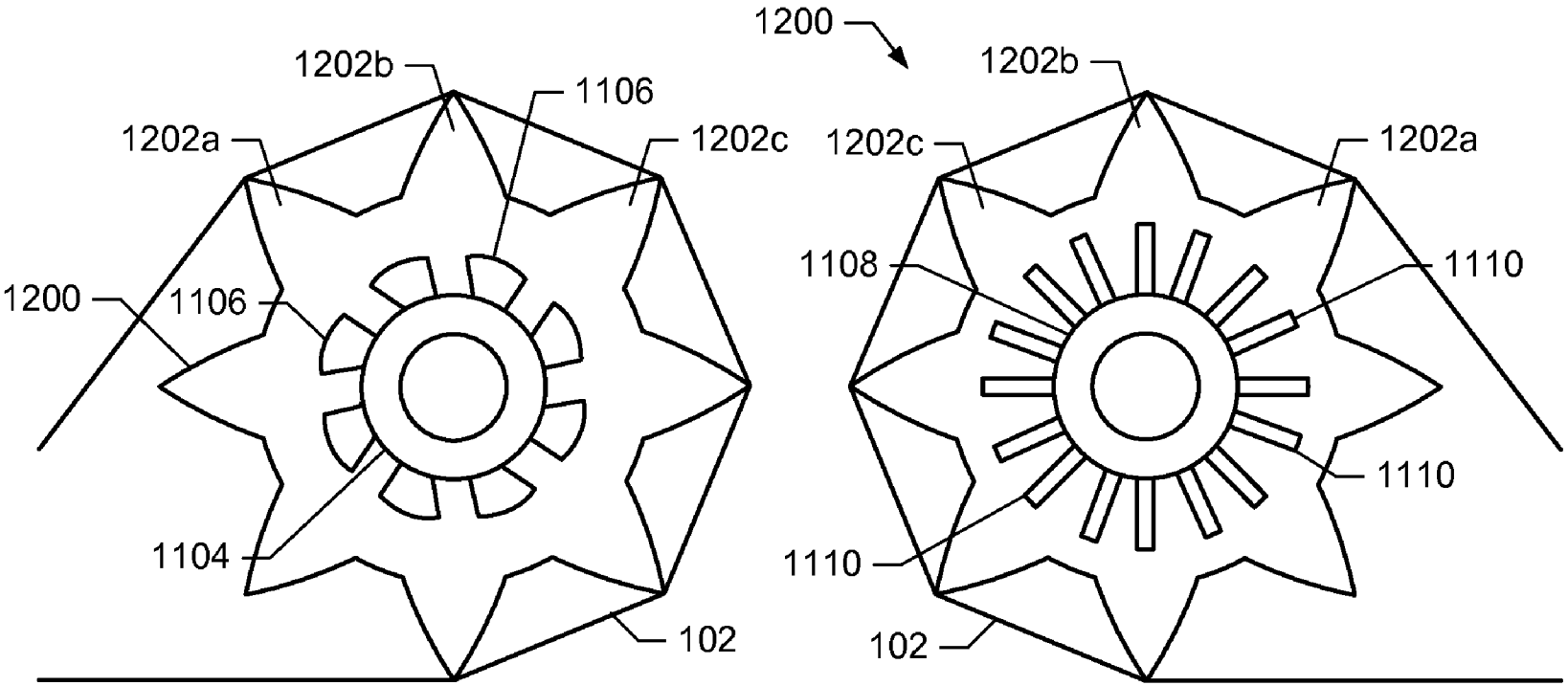
FIGS. 12A and 12B illustrate additional example ratchet and gear configurations for cleaning surface.

FIGS. 12A and 12B show opposite ends of another example roller 1200 that may be used as the cleaning roller 210 of FIG. 2. The example roller 1200 includes several projections 1202*a*-1202*c* to support the cleaning material 102 of FIG. 1. The example roller 1200 includes the ratchet wheel 1104, the gear 1108, and the respective teeth 1106 and 1110 of FIGS. 11A and 11B.

Relative to the faces 1102*a*-1102*c* of the example roller 1100 of FIGS. 11A and 11B, the example projections 1202*a*-1202*c* illustrated in FIGS. 12A and 12B provide a higher contact pressure between the roller 1200 and the surface to be cleaned, thereby achieving higher conformance to the surface and improving cleaning quality.

Figure 13:
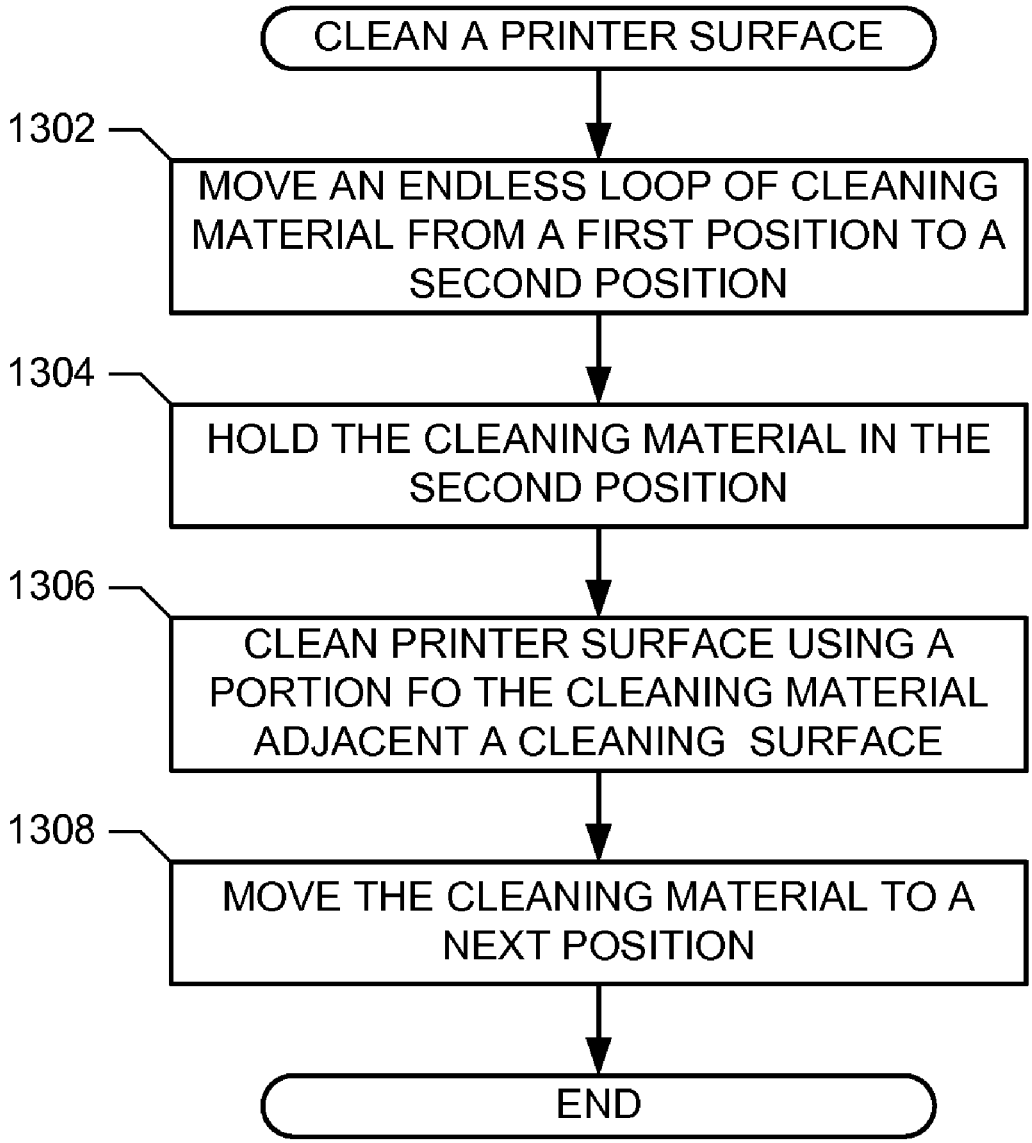
FIG. 13 is a flowchart of an example process to clean a surface in a printer.

FIG. 13 is a flowchart of an example process 1300 to clean a surface in a printer. The example process 1300 may be performed by the endless loop of cleaning material 102 and the advancer 104 of FIGS. 1, 2, and/or 5A-8C. To begin the example process 1300, the advancer 104 moves the endless loop of cleaning material 102 from a first position to a second position (block 1302). For example, a first portion of the cleaning material 102 may be adjacent a cleaning surface (e.g., the cleaning roller 210 of FIG. 2). The example advancer 104 advances the cleaning material 102 so that a second portion of the cleaning material 102 is adjacent the cleaning roller 210.

To advance the cleaning material 102, the example advancer 104 unlocks the ratchet wheel 220 of FIG. 2 and rotates the cleaning roller 210 to cause the cleaning material 102 to rotate and/or advance with the cleaning roller 210. Advancement of the endless loop of cleaning material 102 is described above in conjunction with FIGS. 5A-8C.

The example advancer 104 then locks (e.g., holds, secures) the cleaning material 102 in the second position (block 1304). For example, the advancer 104 may lock the ratchet wheel 220 to substantially prevent further rotation of the cleaning roller 210 and/or advancement of the cleaning material 102.

The cleaning material 102 is used to clean a printer surface using the portion of the cleaning material 102 adjacent the cleaning roller 210 (block 1306). In some examples, the cleaning material 102 may be used to scrub the printer surface. By securing the cleaning material 102 in the second position, a relative motion between cleaning material 102 and the printer surface may be applied to produce a scrubbing action. If the cleaning material 102 was not held in position, the cleaning material may advance and/or retract due to friction with the printer surface, and a reduced or no scrubbing action would be produced.

After the cleaning operation, the advancer 104 moves the endless loop of cleaning material 102 to a next position (e.g., a third position, the first position, etc.) (block 1308). In some examples, the advancer 104 may advance the endless loop of cleaning material 102 incrementally over the course of multiple cleaning procedures until the cleaning material 102 is substantially in the first position again. An incremental advancement of the cleaning material may include rotating the ratchet wheel 220 one or more positions (e.g., notches). The incremental distance may be based on, for example, the diameter of the cleaning roller 210, the number and/or spacing of the ratchet teeth 518, and/or the size of the surface 306 being cleaned. In some other examples, the advancer 104 may reverse the direction of advancement of the endless loop of cleaning material 102 using, for example, an electronic actuator to rotate the cleaning roller 210 (or another roller) in multiple directions. The example process 1300 may then end and/or iterate to reuse the endless loop of cleaning material 102 for additional cleaning procedures.

From the foregoing, it will be appreciated that example printers and apparatus have been described herein which provide economical cleaning for printer surfaces. Example printers and apparatus described herein use an endless loop of cleaning material that may be reused for multiple cleaning procedures, thereby reducing a cost per cleaning procedure. Example printers and apparatus disclosed herein enable drying of a portion of the cleaning material after a first cleaning procedure before that same portion of the cleaning material can be used in a later cleaning procedure. Additionally, example printers and apparatus disclosed herein may be economically implemented with fewer mechanical actuators to advance the cleaning material than in prior approaches. Example printers and apparatus disclosed herein also provide an enhanced cleaning for printer surfaces by holding the cleaning material in a fixed or substantially fixed position during a cleaning procedure.

Although certain methods, apparatus, and articles of manufacture have been described herein, the scope of coverage of this patent is not limited thereto. To the contrary, this patent covers all methods, apparatus, and articles of manufacture falling within the scope of the claims.

What is claimed is:

1. An apparatus to clean a surface in a printer, comprising:
an endless cleaning material loop; and
an advancer to advance the cleaning material loop when the loop is not engaged with the surface and to not advance the loop when the loop is engaged with the surface.

2. An apparatus as defined in claim 1, further comprising a contact surface to support the cleaning material loop.

3. An apparatus as defined in claim 2, wherein the advancer advances the cleaning material loop incrementally by moving the cleaning material a fraction of a full rotation of the endless loop.

4. An apparatus as defined in claim 1, wherein the advancer comprises a ratchet wheel to selectively prevent rotation of the cleaning material loop.

5. An apparatus as defined in claim 4, further comprising a pawl to selectively lock the ratchet wheel, and a pawl actuator to move the pawl out of engagement with the ratchet wheel.

6. An apparatus as defined in claim 5, wherein the pawl locks the ratchet wheel to prevent the advancer from advancing the cleaning material.

7. An apparatus as defined in claim 4, wherein the advancer comprises a gear to advance the loop.

8. An apparatus as defined in claim 7, wherein the advancer comprises an indexer to actuate the gear when the ratchet is unlocked.

9. An apparatus as defined in claim 1, wherein contaminants on a first portion of the cleaning material are given time after a first cleaning procedure to adhere to the cleaning material before the first portion of the cleaning material is positioned for a second cleaning procedure.

10. An apparatus as defined in claim 1, wherein the advancer is to advance the cleaning material a distance different from a full revolution of the loop.

11. A method to clean a print surface, comprising:
advancing an endless loop of cleaning material from a first position to a second position different from the first position;
securing the cleaning material in the second position such that the cleaning material does not move during a subsequent cleaning of a surface;
cleaning the surface using a portion of the cleaning material; and
advancing the cleaning material to a third position different from the first and second position.

12. A method as defined in claim 11, wherein the portion of the cleaning material is adjacent a cleaning surface when secured in the second position.

13. A method as defined in claim 11, wherein advancing the cleaning material to the third position comprises incrementally advancing the cleaning material multiple times.

14. A method as defined in claim 11, further comprising cleaning the surface with the portion a second time after a contaminant on the portion has adhered to the portion.

15. A method as defined in claim 11, wherein securing the cleaning material in the second position comprises engaging a ratchet wheel with a pawl.

16. A printer, comprising:
a surface that collects a contaminant;
an endless loop of cleaning material;
a housing to support the cleaning material, wherein at least one of the housing or the surface is to reciprocate between a first position and a second position, the cleaning material to contact the surface when the housing or the surface is in the second position; and
an advancer driven by movement of at least one of the housing or the surface from the first position to the second position to incrementally advance the cleaning material when the cleaning material is not in contact with the surface and to secure the cleaning material when the cleaning material is in contact with the surface.

17. A printer as defined in claim 16, further comprising a roller to rotate to advance the cleaning material from a third position to a fourth position.

18. A printer as defined in claim 17, wherein the advancer comprises an indexer gear to rotate the roller to advance the cleaning material when the housing or the surface moves from the first position to the second position, and a ratchet wheel to prevent the roller from rotating when the housing or the surface moves from the second position to the first position.

19. A printer as defined in claim 18, further comprising:

a pawl to engage the ratchet wheel to secure the cleaning material; and a pawl actuator to cause the pawl to disengage the ratchet wheel when at least one of the housing or the surface moves from the first position to the second position to free the roller to rotate.

20. A printer as defined in claim 16, further comprising an idle roller to define a travel path for the cleaning material.

* * * * *